US011493001B1

(12) United States Patent
Dudar et al.

(10) Patent No.: US 11,493,001 B1
(45) Date of Patent: Nov. 8, 2022

(54) ONBOARD REFUELING VAPOR RECOVERY FOR HEAVY DUTY APPLICATIONS

(71) Applicant: Ford Global Technologies, LLC, Dearborn, MI (US)

(72) Inventors: Aed Dudar, Canton, CA (US); Scott Bohr, Novi, MI (US); Donald Ignasiak, Farmington Hills, MI (US); Chuck Bartus, Grosse Ile, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/449,219

(22) Filed: Sep. 28, 2021

(51) Int. Cl.
*F02M 25/08* (2006.01)

(52) U.S. Cl.
CPC ..... *F02M 25/0854* (2013.01); *F02M 25/089* (2013.01); *F02M 25/0818* (2013.01); *F02M 25/0836* (2013.01)

(58) Field of Classification Search
CPC ..... F02M 25/0809; F02M 25/0836; F02M 25/0854; F02M 25/0872; F02M 25/089; F02M 25/08; F02M 25/0818
See application file for complete search history.

(56) References Cited

U.S. PATENT DOCUMENTS 5,056,494 A * 10/1991 Kayanuma ..... F02M 25/0872 123/519
5,111,795 A * 5/1992 Thompson ..... F02M 25/0872 123/519
5,165,379 A * 11/1992 Thompson ..... B60K 15/03504 280/834
5,697,348 A * 12/1997 Schwager ..... F02M 25/0836 123/520
8,495,988 B2 7/2013 Reddy
9,518,538 B2 12/2016 Pearce
2009/0007890 A1* 1/2009 Devries ..... F02M 25/089 123/520
2016/0025019 A1* 1/2016 Pearce ..... F02M 25/0854 123/519

FOREIGN PATENT DOCUMENTS

JP 2002122048 A * 4/2002
KR 100792864 B1 1/2008

* cited by examiner

*Primary Examiner* — George C Jin
*Assistant Examiner* — Teuta B Holbrook
(74) *Attorney, Agent, or Firm* — Vincent Mastrogiacomo; McCoy Russell LLP

(57) ABSTRACT

Methods and systems are provided for an evaporative emissions control system for onboard refueling vapor recovery of a heavy duty vehicle. In one example, a method may include adjusting flow among at least two canisters during canister purging, where the at least two canisters are arranged in a parallel loading and unloading flow direction, to increase flow through a higher loaded canister. Flow may be adjusted using a first valve coupled to the first canister, a second valve coupled to the second canister, and so on for n number of canisters and n number of valves, and a balancing valve used to selectively couple the at least two canisters to a fuel tank.

20 Claims, 10 Drawing Sheets

ONBOARD REFUELING VAPOR RECOVERY FOR HEAVY DUTY APPLICATIONS

FIELD

The present description relates generally to methods and systems for an evaporative emissions control system of a vehicle.

BACKGROUND/SUMMARY

Vehicle fuel systems include evaporative emission control systems (EVAP) designed to reduce the release of fuel vapors to the atmosphere. For example, vaporized hydrocarbons (HCs) from a fuel tank may be stored in a fuel vapor canister packed with an adsorbent which adsorbs and stores the vapors. At a later time, when the engine is in operation, the evaporative emission control system allows the vapors to be purged into the engine intake manifold for use as fuel. Fuel vapors may be generated as refueling, running loss, hot soak, and diurnal temperature vapors. In a hybrid vehicle, the fuel vapors stored in the canister are primarily refueling vapors.

Two conventional methods are widely used for recovery of refueling vapors: onboard refueling vapor recovery (ORVR) and offboard refueling vapor recovery (non-ORVR). Examples of conventional vehicles using non-ORVR may include heavy duty vehicles weighing over 8500 pounds. In a non-ORVR vehicle, refueling vapors may be recovered by infrastructure of a gas station, such as a gas station recovery tank. Gas station infrastructure may include refueling nozzles with boots that seal around the filler neck for offboard recovery. However, some gas station infrastructures may not include refueling nozzles configured for offboard recovery. In this case, fuel vapors may escape to atmosphere. For heavy duty vehicles with large fuel tanks, e.g., H2 motor home applications with 80-gallon fuel tanks, escaped fuel vapors may contribute to negative effects of vehicle emissions.

An option for mitigating negative effects of vehicle emissions is onboard refueling vapor recovery (ORVR), where the canister is sized to adsorb refueling, running loss, hot soak, and diurnal temperature vapors. The canister size may be determined by an amount of refueling vapors output by the vehicle, as refueling vapors are the largest contributors to vapors of the aforementioned vapors. Canisters for vehicles using ORVR are larger than canisters for vehicles using non-ORVR due to fuel vapor recovery by gas station infrastructure in vehicles with offboard recovery rather than relying on recovery via onboard canisters.

Demand for heavy duty vehicles with ORVR is increasing. For example, the Environmental Protection Agency is in the process of updating regulations for heavy duty incomplete programs, including the Cleaner Trucks Initiative, to require heavy duty incompletes to use ORVR by 2026MY. Conventional EVAP system hardware in heavy duty incompletes may not be equipped to be used for ORVR. For example, a size of a canister may be proportional to a size of a fuel tank, such that vehicles with a large fuel tank include a large canister to process fuel vapors. However, incorporating a large canister may pose challenges during vehicle refueling. For example, large canisters may increase restriction of vapor flow in the canister, which reduces robustness of refueling quality due to system back pressure from the canister as fuel vapors from refueling are loaded into the canister. A back pressure of 10 inH2O may shut off the refueling pump at gas station infrastructure. Canisters may also have inherent restriction from the carbon pellets embedded therein used to capture fuel vapors.

Attempts to address this challenge include using smaller canisters arranged in series or in parallel to achieve refueling vapor capacity needed for large fuel tanks while reducing canister restriction. However, this system may be limited by a desired footprint and cost of the EVAP, as well as the inherent canister restriction. For example, when considering canisters manufactured with a same volumetric capacity, e.g., symmetric canisters, restriction of each canister may be inherently variable by approximately 10%. If, when multiple canisters are used, flow during purging favors a less restricted canister (e.g., less loaded), then a more restricted canister (e.g., higher loaded) may not be purged as efficiently as the less restricted canister, which may increase evaporative emissions and reduce a useful lifetime of the multiple canisters. Hence a method is desired for selectively adjusting the flow of air going into a multiple canister system to reduce canister restriction and ensure that individual canisters are purged efficiently.

One example approach is shown by Reddy in U.S. Pat. No. 8,495,988B2. Therein, a three-way valve is arranged between two canisters in series in an attempt to balance a flow among the two canisters during canister purging for ORVR. Additionally, one of the two canisters includes an electrically heatable substrate thermally coupled to fuel adsorbent material and a vent valve to connect the canister to atmospheric air. In this example, fuel vapor is first directed to the canister with the heatable substrate, then to the canister without the substrate. In this way, the canister with the substrate may endure a higher fuel vapor load compared to the canister without the substrate. However, the system may not include a method to selectively direct flow to one of the two canisters (e.g., the substrate canister or the non-substrate canister) while isolating the other of the two canisters.

Another example approach includes arranging canisters in parallel to reduce a restriction that may occur in a single large canister or in smaller canisters positioned in series. By arranging the canisters in parallel instead of in series, fuel vapor and air may flow through one of the two canisters instead of through a first canister then through a second canister. In this way, the total air/fuel vapor flow may be divided among the canisters in parallel. However, due to restrictions of the individual canisters, flow through each of the canisters may not be equal, as a more restricted canister may have less available volume and/or less substrate to trap the fuel vapors, which may backflow into the EVAP system or be released to atmosphere.

In one example, the issues described above may be addressed by a method for purging at least two canisters arranged in a parallel loading flow direction and unloading flow direction by adjusting a flow of fuel vapors between the at least two canisters to increase a flow through a higher loaded canister of the at least two canisters during purging of the at least two canisters. In this way, the flow among the at least two canisters may be balanced such that each of the at least two canisters is loaded with an equal amount of fuel vapor, respective to a restriction/load of each canister, allowing the at least two canisters to efficiently capture and purge fuel vapors.

As one example, the flow may be adjusted using a balance valve included on a bifurcated load line upstream of a first canister and a second canister of the at least two canisters, a first canister vent valve coupling the first canister to the atmosphere via a vent line, and a second canister vent valve coupling the second canister to the atmosphere via the vent line. The first and the second canister vent valves may be independently actuated to isolate the respective canister and may be used along with the balance valve to adjust air flow through each of the first and the second canisters during purging. The first canister and the second canister may be purged to an engine via a purge line configured with a canister purge valve.

In a second example, the flow may be adjusted using a balance valve included on a single load line (e.g., with n number of branches, for example three branches with n=3) upstream of n number of canisters and n number of canister vent valves, each of the n number of canisters being configured with a canister vent valve such that a system with n number of canisters has n number of canister vent valves. Each of the n number of branches of the load line may couple at least one of the n number of canisters to a single fuel tank. The balance valve may have n positions which may be used to couple at least one of the n number of canisters to the fuel tank. Each of the n number of canister vent valves may couple the respective canister of the n number of canisters to the atmosphere via a single vent line. Each of the n number of canister vent valves may be independently actuated to isolate the respective canister and be used along with the balance valve to adjust air flow through each of the n number of canisters during purging. The n number of canisters may be purged to an engine via at least one purge line configured with at least one canister purge valve.

In this way, the flow can be adjusted to increase flow through the more restricted canister of the at least two canisters such that the canisters are efficiently purged in regards to restriction of each canister. Arranging canisters in parallel reduces back pressure associated with a single large canister, and using the balancing valve as well as a canister vent valves for each of the at least two canisters to adjust flow allows for selective and dynamic adjusting of the flow throughout a vehicle lifetime that can adapt to changes in canister restrictions over time.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for onboard refueling vapor recovery (ORVR) in heavy duty vehicles. An evaporative emissions control (EVAP) system configured for ORVR includes a fuel tank fluidly coupled to at least two canisters via a single passage with a number of branches equal to a number of canisters with a balance valve arranged upstream of a branching point of the passage relative to a direction of fuel vapor flow. Additionally, the at least two canisters are each coupled to a canister vent valve of n number of canister vent valves, that may be actuated to isolate the respective canister from the atmosphere, where the number of canister vent valves is equal to the number of canisters. The method for ORVR using this system includes purging the at least two canisters, which are arranged in a parallel loading and unloading flow direction, by adjusting flow among the at least two canisters to increase flow through a higher loaded canister of the at least two second canisters.

Figure 1:
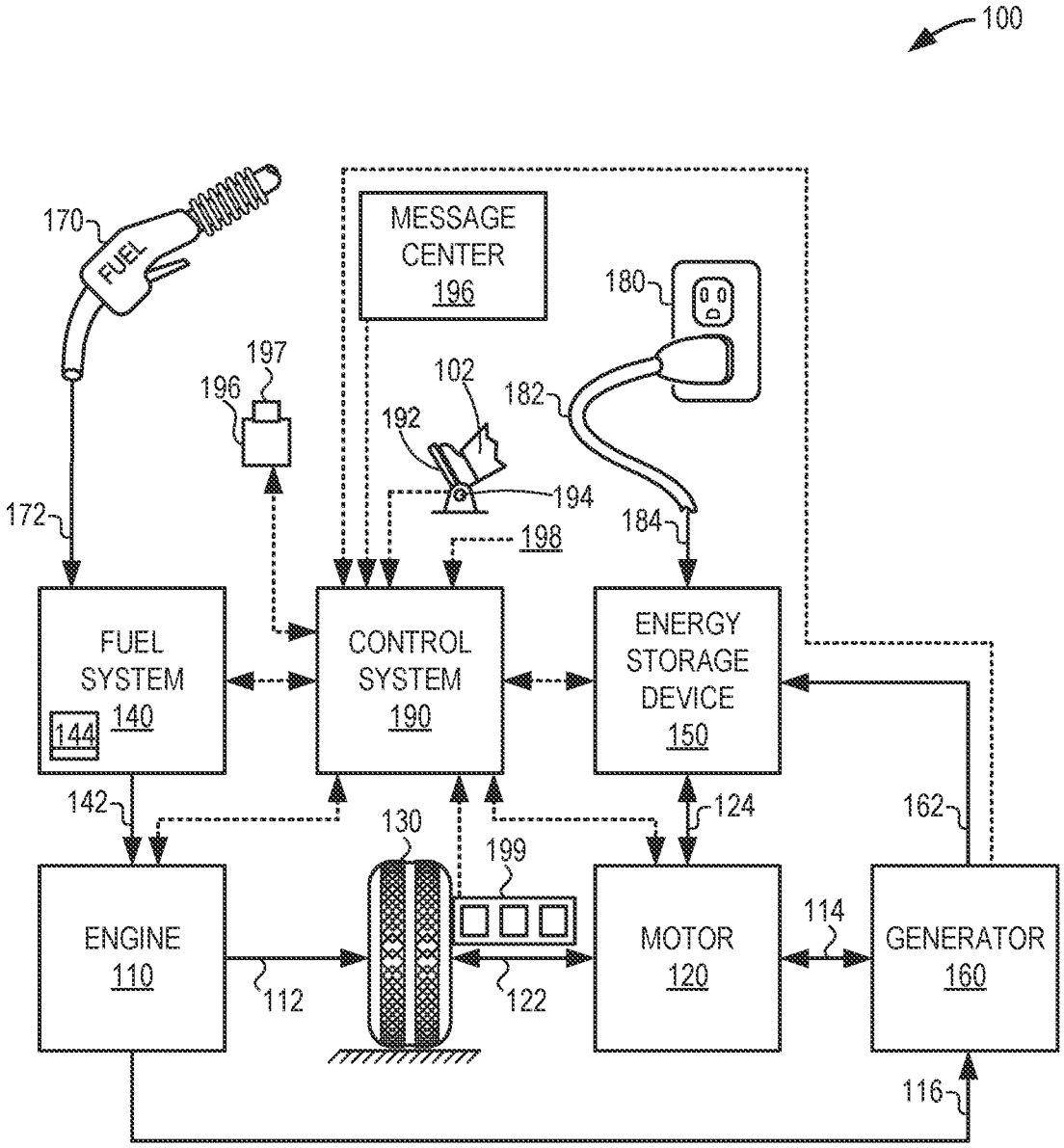
FIG. 1 shows a high-level block diagram illustrating an example vehicle propulsion system.
Figure 3:
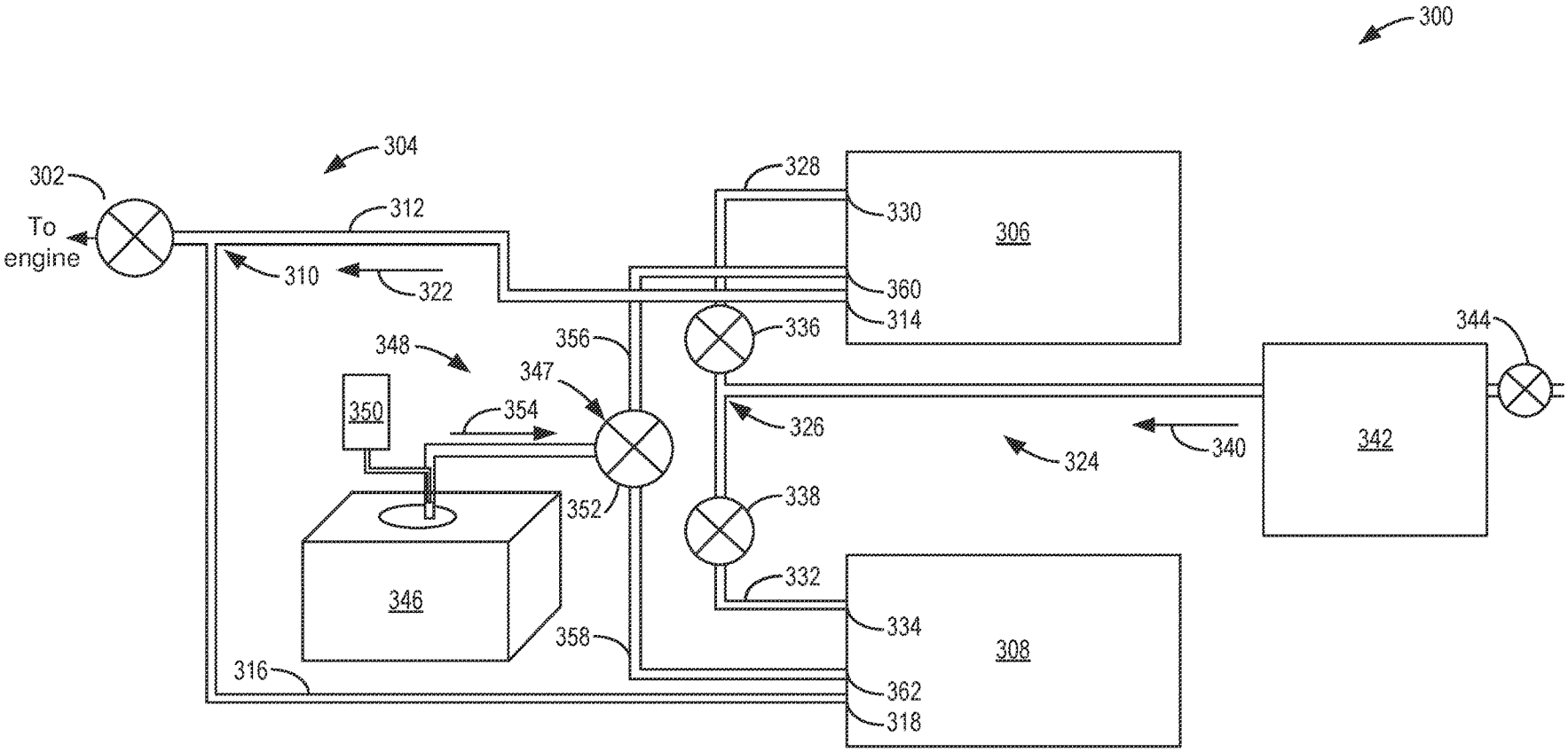
FIG. 3 shows a first example EVAP system, which may be an example of the EVAP system of FIG. 2.
Figure 4:
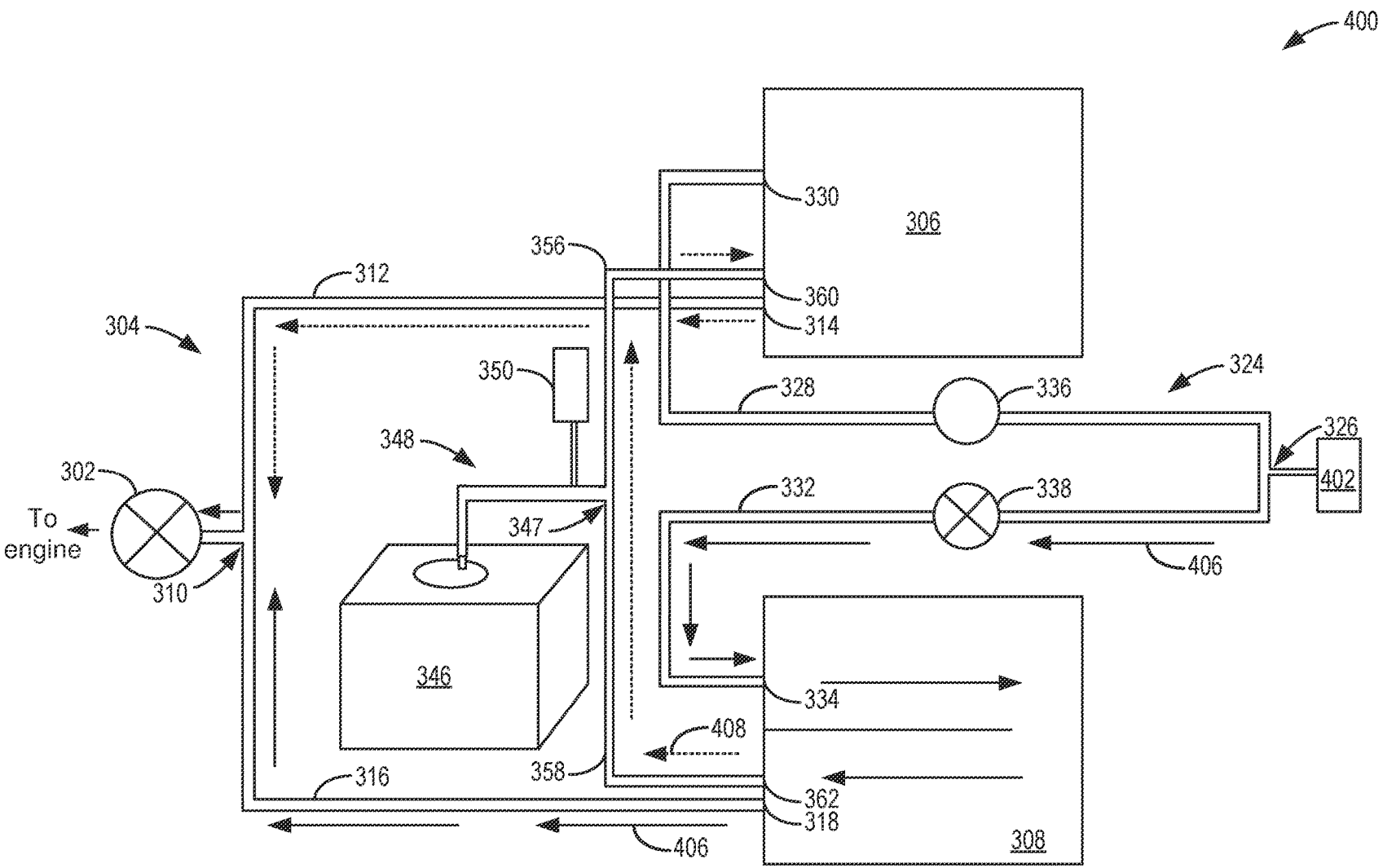
FIG. 4 shows a second example EVAP, which may be an example of the EVAP system of FIG. 2.

Vehicle propulsion systems for a hybrid electric vehicle, an example of which is shown in FIG. 1, may include a fuel burning engine and a motor. The engine may be coupled to a fuel system and an evaporative emissions control system, shown in FIG. 2, which may recover fuel vapors from the fuel tank, such as fuel vapors generated during refueling, and may store the captured fuel vapors in a fuel vapor canister, and then purge the captured fuel vapors into an engine intake system to be used as fuel. FIG. 3 shows an example evaporative emissions control system, as may be included in FIG. 2, configured with two fuel vapor canisters arranged in the parallel loading and unloading flow direction, each of the canisters configured with a canister vent valve to selectively isolate the respective canister from the atmosphere. The evaporative emissions control system of FIG. 3 may be configured with more than one fuel vapor canisters, each with a canister vent valve. The evaporative emissions control system of FIG. 3 also includes a balance valve on a load line, which can be used to selectively couple one or both of the canisters to the fuel tank. When configured with two canisters, the balance valve may be a three-way balance valve and, when configured with n number of canisters, the balance valve may be a n-way balance valve. FIG. 4 shows the example evaporative emissions control system of FIG. 3 without the balance valve and with arrows indicating flow paths that may occur during canister purging when the balance valve is not included. FIGS. 5-6 and 8-9 show example methods by which flow may be adjusted during canister purging to increase flow through a higher loaded canister of the two canisters shown in FIG. 3, which includes measuring a restriction/load of each canister and learning a duty cycle for each of the two canister vent valves. The methods of FIGS. 5-6 and 8-9 may be applied to evaporative emissions control system configured with n number of canisters and n number of canister vent valves. FIG. 10 shows an example canister purging sequence according to the method of FIG. 9, including example positions of the two canister vent valves, the balance valve, the canister purge valve, and pressure of the first and the second canisters. FIGS. 7A-B shows example positions of the two canister vent valves and the balance valve, as well as flow direction, during measurements of canister restriction.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (e.g., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may be disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle, such as from solar or wind energy. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

Figure 2:
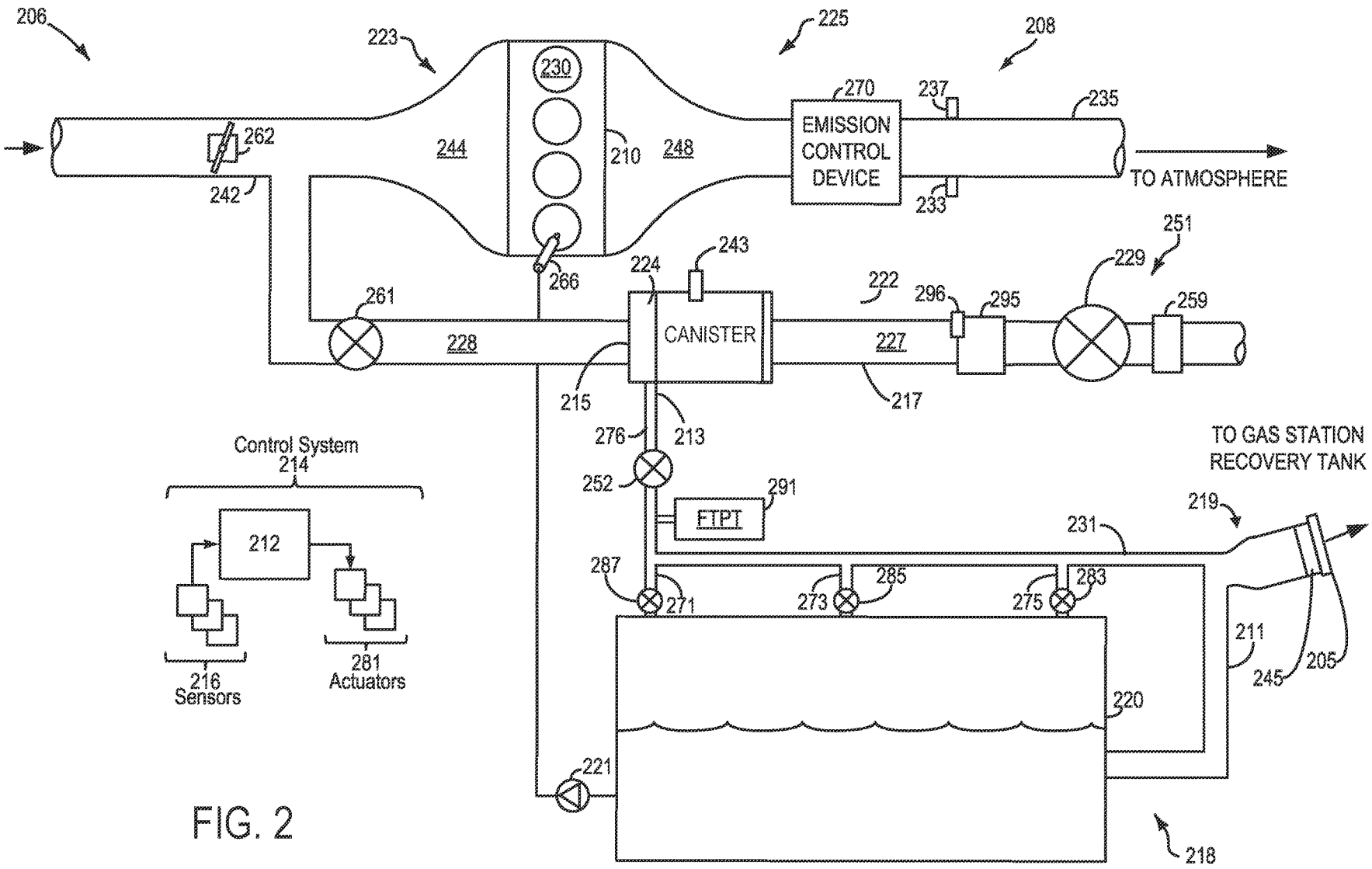
FIG. 2 shows an example engine system, fuel system, and evaporative emissions control (EVAP) system included in the example vehicle system of FIG. 1.

FIG. 2 shows a schematic depiction of a vehicle system 206. The vehicle system 206 includes an engine system 208 coupled to an evaporative emissions control system 251 and a fuel system 218. Emissions control system 251 includes a fuel vapor container such as fuel vapor canister 222 which may be used to capture and store fuel vapors. In some examples, vehicle system 206 may be a hybrid electric vehicle system, such as the vehicle propulsion system 100 of FIG. 1.

The engine system 208 may include engine 210 having a plurality of cylinders 230. In one example, engine 210 is an embodiment of engine 110 of FIG. 1. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. In one example, fuel tank 220 includes fuel tank 144 of FIG. 1. The fuel pump system 221 may include one or more pumps for pressurizing fuel delivered to the injectors of engine 210, such as an example injector 266 shown. While a single injector 266 is shown, additional injectors are provided for each cylinder. It will be appreciated that fuel system 218 may be a return-less fuel system, a return fuel system, or various other types of fuel system.

Vapors generated in fuel system 218 may be routed to the evaporative emissions control system 251, which includes fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves may be positioned in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a refueling system 219. In some examples, refueling system 219 may include a fuel cap 205 for sealing off the fuel filler system from the atmosphere. Refueling system 219 is coupled to fuel tank 220 via a fuel filler pipe 211.

Further, refueling system 219 may include a refueling lock 245. In some embodiments, the refueling lock 245 may be a fuel cap locking mechanism. The fuel cap locking mechanism may be configured to automatically lock the fuel cap 205 in a closed position so that the fuel cap cannot be opened. For example, the fuel cap 205 may remain locked via refueling lock 245 while pressure or vacuum in the fuel tank 220 is greater than a threshold. In response to a refueling request, e.g., a vehicle operator initiated request via actuation of a refueling button on a vehicle dashboard (such as refueling button 197 on vehicle instrument panel 196 of FIG. 1), the fuel tank may be depressurized and the fuel cap unlocked after the pressure or vacuum in the fuel tank falls below a threshold. Herein, unlocking the refueling lock 245 may include unlocking the fuel cap 205. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more fuel vapor canisters 222 (herein also referred to simply as canister) filled with an appropriate adsorbent, the canisters configured to temporarily trap fuel vapors (including vaporized hydrocarbons) generated during fuel tank refilling operations and "running loss" vapors (that is, fuel vaporized during vehicle operation). In one example, the adsorbent used is activated charcoal. Emissions control system 251 may further include a canister ventilation path or vent line 227 which may route gases out of the fuel vapor canister 222 to the atmosphere when storing, or trapping, fuel vapors from fuel system 218. When the emissions control system 251 includes more than one canister 222, the canisters may be arranged in series or in parallel. When the canisters are arranged in series, gases may be routed to a first canister of the more than one canisters, then from the first canister to a second canister of the more than one canisters, and so on for additional canisters of the one or more canisters. When two canisters are arranged in parallel, a total volume of gases routed through the more than one canisters may be routed to the first canister or the second canister, or the total volume of gases may be divided into two volumes with a first volume of the two volumes routed through the first canister and a second volume of the two volumes routed through the second canister. Arranging the more than one canisters in parallel may be preferential to arranging the more than one canisters in series, because with canisters in parallel, restrictions (e.g., back pressure) from the first and the second canisters may be separated such that a first restriction of the first canister may not affect a flow rate of the second volume routed through the second canister, which may have a second, different restriction, and so on for additional canisters of the one or more canisters. Routing the flow of fuel vapors through parallel canisters and canister restriction is further described in FIGS. 3-9.

Vent line 227 may also allow fresh air to be drawn into canister 222 via vent valve 229 when purging stored fuel vapors from fuel system 218 to engine intake 223 via purge line 228 and purge valve 261. For example, purge valve 261 may be normally closed but may be opened during certain conditions (such as certain engine running conditions) so that vacuum from engine intake manifold 244 is applied on the fuel vapor canister for purging. In some examples, vent line 227 may include an optional air filter 259 disposed therein upstream of canister 222. Flow of air and vapors between canister 222 and the atmosphere may be regulated by canister vent valve 229.

Undesired evaporative emission detection routines may be intermittently performed by controller 212 on fuel system 218 to confirm that the fuel system is not degraded. As such, undesired evaporative emission detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, undesired evaporative emission detection routines may be performed while the engine is running by operating a vacuum pump and/or using engine intake manifold vacuum. Undesired evaporative emission tests may be performed by an evaporative leak check module (ELCM) 295 communicatively coupled to controller 212. ELCM 295 may be coupled in vent line 227, between canister 222 and the vent valve 229. ELCM 295 may include a vacuum pump configured to apply a negative pressure to the fuel system when in a first conformation, such as when administering a leak test. ELCM 295 may further include a reference orifice and a pressure sensor 296. Following the application of vacuum to the fuel system, a change in pressure at the reference orifice (e.g., an absolute change or a rate of change) may be monitored and compared to a threshold. Based on the comparison, undesired evaporative emissions from the fuel system may be identified. The ELCM vacuum pump may be a reversible vacuum pump, and thus configured to apply a positive pressure to the fuel system when a bridging circuit is reversed placing the pump in a second conformation.

Canister 222 is configured as a multi-port canister. In the depicted example, canister 222 has three ports, to be further described in FIG. 3. These include a first load port 213 coupled to conduit 276 through which fuel vapors from fuel tank 220 are received in canister 222. In other words, fuel vapors that are to be absorbed in the canister 222 may be received via load port 213. Canister 222 further includes a second purge port 215 coupled to purge line 228 through which fuel vapors stored in the canister 222 can be released to the engine intake for combustion. In other words, fuel vapors that are desorbed from the canister 222 are purged to the engine intake via purge port 215. Canister 222 further includes a third purge port 217 coupled to vent line 227 through which air flow is received in the canister 222. The ambient air may be received in the canister for flowing through the adsorbent and releasing fuel vapors to the engine intake. Alternatively, air containing fuel vapors received in the canister via load port 213 may be vented to the atmosphere after the fuel vapors are adsorbed in canister 222.

Canister 222 may include a first buffer 224 surrounding load port 213. Like canister 222, buffer 224 may also include adsorbent. The volume of buffer 224 may be smaller than (e.g., a fraction of) the volume of canister 222. The adsorbent in the buffer 224 may be same as, or different from, the adsorbent in the canister (e.g., both may include charcoal). Buffer 224 may be positioned within canister 222 such that during canister loading through load port 213, fuel tank vapors are first adsorbed within the buffer, and then when the buffer is saturated, further fuel tank vapors are adsorbed in the main body of the canister. In comparison, when purging canister 222 with air drawn through vent line 227, fuel vapors are first desorbed from the canister (e.g., to a threshold amount) before being desorbed from the buffer. In comparison, when purging canister 222 with air drawn through vent line 227, fuel vapors are first desorbed from the canister (e.g., to a threshold amount) before being desorbed from the buffer. In other words, loading and unloading of buffer 224 is not linear with the loading and unloading of the canister. As such, the effect of the canister buffer is to dampen any fuel vapor spikes flowing from the fuel tank to the canister, thereby reducing the possibility of any fuel vapor spikes going to the engine or being released through a tailpipe.

Fuel tank 220 is fluidically coupled to canister 222 via a first conduit 276, the first conduit diverging from a fuel tank isolation valve (FTIV) 252 which controls the flow of fuel tank vapors from fuel tank 220 and vapor recovery line 231 into canister 222. In the depicted example, FTIV 252 is configured as a multi-way solenoid valve, specifically, a three-way valve. By adjusting a position of FTIV 252, fuel vapor flow from the fuel tank 220 to the canister 222 can be varied. FTIV 252 may be actuated to a first, open position that couples fuel tank 220 to canister 222 via conduit 276. In an example where the emissions control system 251 includes more than one canister 222 arranged in parallel, adjusting the position of the FTIV 252 to a first position may direct fuel vapor flow from the fuel tank 220 to a first canister, adjusting to a second position may direct fuel vapor flow from the fuel tank 220 to a second canister, and adjusting to a third position may direct fuel vapor flow from the fuel tank 220 to both the first and the second canisters. The FTIV may also be actuated to a fourth, closed position.

For example, FTIV 252 may be actuated to a closed position that seals fuel tank 220 from canister 222 when the emissions control system 251 includes one canister 222, wherein no fuel vapors flow through conduit 276. In the example where the emissions control system 251 includes more than one canister 222 arranged in parallel, the closed position seals fuel tank 220 from both of the first and the second canisters, wherein no fuel vapors flow through either of a first or a second canister conduit, which may branch off from the first conduit 276, to couple the fuel tank 220 to the first and the second canisters, respectively. Controller 212 may command an FTIV position based on fuel system conditions including an operator request for refueling, fuel tank pressure, and canister load. In a second example, a 0.03" orifice is included in the place of FTIV 252 to restrict vapor flow to the canister.

In configurations where the vehicle system 206 is a hybrid electric vehicle (HEV), fuel tank 220 may be designed as a sealed fuel tank that can withstand pressure fluctuations typically encountered during normal vehicle operation and diurnal temperature cycles (e.g., steel fuel tank). In addition, the size of the canister 222 may be reduced to account for the reduced engine operation times in a hybrid vehicle. However, for the same reason, HEVs may also have limited opportunities for fuel vapor canister purging operations. Therefore, the use of a sealed fuel tank with a closed FTIV (also referred to as NIRCOS, or Non-Integrated Refueling Canister Only System), prevents diurnal and running loss vapors from loading the fuel vapor canister 222, and limits fuel vapor canister loading via refueling vapors only. FTIV 252 may be selectively opened responsive to a refueling request to depressurize the fuel tank 220 before fuel can be received into the fuel tank via fuel filler pipe 211. In particular, when the emissions control system 251 includes one canister 222, FTIV 252 may be actuated to the first open position to depressurize the fuel tank to the canister via first conduit 276 and canister load port 213.

In some embodiments (not shown), a pressure control valve (PCV) may be configured in a conduit coupling fuel tank 220 to canister 222 in parallel to conduit 276. When included, the PCV may be controlled by the powertrain control module (e.g. controller 212) using a pulse-width modulation cycle to relieve any excessive pressure generated in the fuel tank, such as while the engine is running. Additionally or optionally, the PCV may be pulse-width modulated to vent excessive pressure from the fuel tank when the vehicle is operating in electric vehicle mode, for example in the case of a hybrid electric vehicle.

When transitioned to a second (open) position for the emissions control system 251 with one canister 222, FTIV 252 allows for the venting of fuel vapors from fuel tank 220 to canister 222. The second open position may be a fully open position and the first open position may be a partially open position, e.g., half open.

For the emissions control system 251 with at least one canister 222, including more than one canister 222 arranged in parallel, fuel vapors may be stored in canister 222 while air stripped off fuel vapors exits into atmosphere via canister vent valve 229. Stored fuel vapors in the canister 222 may be purged to engine intake 223, when engine conditions permit, via the purge valve 261. Refueling lock 245 may be unlocked to open a fuel cap after fuel tank is sufficiently depressurized, such as below the second threshold pressure.

The vehicle system 206 may further include a control system 214 (such as control system 190 of FIG. 1). Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, exhaust temperature or pressure sensor 233, fuel tank pressure transducer (FTPT) or pressure sensor 291, canister load sensor 243, and ELCM pressure sensor 296. As such, pressure sensor 291 provides an estimate of fuel system pressure. In one example, the fuel system pressure is a fuel tank pressure, e.g. within fuel tank 220. Other sensors such as pressure, temperature, air/fuel ratio, and composition sensors may be coupled to various locations in the vehicle system 206. As another example, the actuators may include the fuel injector 266, the throttle 262, the FTIV 252, the refueling lock 245, the canister vent valve 229, and the purge valve 261. The control system 214 may include a controller 212. The controller may receive input data from the various sensors, process the input data, and trigger the actuators in response to the processed input data based on instruction or code programmed therein corresponding to one or more routines. The controller 212 receives signals from the various sensors of FIGS. 1-2 and employs the various actuators of FIGS. 1-2 to adjust engine operation based on the received signals and instructions stored on a memory of the controller.

For example, responsive to an operator refueling request, the controller may retrieve sensor input from fuel tank pressure sensor 291 and compare it to a threshold. If the pressure is higher than the threshold, the controller may send a signal commanding FTIV 252 to a position that expedites depressurization of the fuel tank. Therein, based on canister load, as estimated via sensor 243, and/or based on an estimated time to depressurize the fuel tank, the controller 212 may adjust the position of FTIV 252 to depressurize the fuel vapors to the load port 213 of canister 222. Once the fuel tank has been sufficiently depressurized, as inferred based on the fuel tank pressure sensor output, the controller may send a signal commanding the refueling lock 245 to open or disengage so that fuel can be received in fuel tank 220 via the fuel filler pipe 211.

If the EVAP system of FIG. 2, including the emissions control system 251 and the fuel system 218, were to be included in a heavy-duty vehicle with a large fuel tank, as described above, the canister may be too small to effectively capture fuel vapors from the fuel tank, e.g., the canister may have a volume smaller than a volume of the fuel tank. Though the EVAP system of FIG. 2 may recirculate fuel vapors through the fuel tank via the vapor recovery line 231 and the fuel filler pipe 211, a majority of the fuel vapors may be emitted to the atmosphere via the refueling system 219 when the canister is small. In this example, the EVAP system of FIG. 2 may be an element of an offboard refueling vapor recovery (non-ORVR) vehicle.

An EVAP system of a vehicle configured for onboard refueling vapor recovery (ORVR) may include similar elements as described in FIG. 2, such as the engine system 208, an EVAP system, and a fuel system. However, in the example of heavy duty vehicles with large (e.g., 80 gallon) fuel tanks, the EVAP system and the fuel system may be modified for ORVR to efficiently capture fuel vapors of the large fuel tank and purge captured vapors to be used by the engine as fuel. In various embodiments, a plurality (e.g., at least two) of symmetric (e.g., same volumetric capacity) fuel vapor canisters may be arranged in parallel along a loading and unloading flow direction so that a total volume of fuel vapors may be equally divided and captured by the plurality of canisters. However, the symmetric canisters may have inherent restrictions from adsorbent elements in each canister that may cause the symmetric canisters to have different levels of restriction. Less fuel vapor and/or air may flow through a more restricted canister (e.g., higher loaded) compared to a less restricted canister (e.g., less loaded). Thus, a method to adjust a flow of the fuel vapor and/or air among at least two canisters during canister purging, where the at least two canisters are arranged in parallel, may result in equal loading of the at least two canisters relative to respective canister restriction. In other words, if a first canister of the at least two canisters has a higher load than a second canister of the at least two canisters, the flow may be increased through the first canister and decreased through the second canister. Alternatively, if the second canister has a higher load than the first canister, the flow may be decreased through the first canister and increased through the second canister. In a configuration with two canisters, the flow may be adjusted using a balance valve used to couple one or both of the canisters to the fuel tank, as well as a first canister vent valve coupled to the first canister and a second canister vent valve coupled to the second canister, each of the first and the second canister vent valves may be independently actuated to selectively isolate the respective canister from the atmosphere and/or purging backflow. In a configuration with n number of canisters (e.g., n=3), the flow may be adjusted using a balancing valve used to couple at least one of then number of canisters to the fuel tank, as well as n number of canister vent valves, each of the n number of canisters configured with a canister vent valve, where each of the n number of canister vent valves may be independently actuated to selectively isolate the respective canister from the atmosphere and/or purging backflow.

FIG. 3 shows a first example EVAP system 300 including two parallel fuel vapor canisters, a balancing valve, canister vent valves, and an optional bleed canister element. EVAP system 300 may be a non-limiting example of EVAP system 251 and fuel system 218 of FIG. 2. For example, EVAP system 300 may be configured with n number of fuel vapor canisters and corresponding elements, as further described below. EVAP system 300 may be coupled to an intake manifold, such as intake manifold 244 of FIG. 2, via a canister purge valve (CPV) 302, which may be equivalent to the purge valve 261 of FIG. 2. The CPV 302 may be positioned on a purge line 304, the purge line 304 selectively coupling each of a first fuel vapor canister 306 and a second fuel vapor canister 308 to the intake manifold via the CPV 302. In one example, the first and the second canisters 306, 308 are symmetric and may each have a volumetric capacity of 2.8 L with a 29×100 mm bleed. In another example, a BAX 1500 may be implemented as each of the first and the second canisters with 15.3 g/dl (100 ml) butane capacity when measured per 100% butane at 250 ml/min at 25° C. The first and the second canisters 306, 308 are arranged in the EVAP system 300 in a parallel loading flow direction and unloading flow direction. For example, the purge line 304 is bifurcated at a first node 310 and the first and the second canisters 306, 308 are positioned on each end of the bifurcation. For example, a first purge branch 312 is coupled to the first canister 306 at a first purge port 314. A second purge branch 316 is coupled to the second canister 308 at a second purge port 318. The first and the second purge branches 312 and 316, respectively, are parallel along the loading and unloading flow direction. The first and the second canisters 306, 308 are further coupled to a vent line 324, the vent line 324 being bifurcated at a second node 326. A first vent branch 328 is coupled to the first canister 306 at a first vent port 330 and a second vent branch 332 is coupled to the second canister 308 at a second vent port 334. The first and the second vent branches 328, 332 each have a valve positioned thereon to control air flow to and selectively isolate the respective canister. For example, a first canister vent valve (CVV) 336 is positioned on the first vent branch 328 and a second CVV 338 is positioned on the second vent branch 332. A portion of the vent line 324 upstream of the bifurcation, with respect to flow as depicted by arrow 340, may vent the EVAP system 300 to atmosphere, in one example. In another example, the EVAP system 300 may be configured with a bleed canister element (e.g., 35×100 mm) 342 and a third CVV 344 where, when the third CVV 344 is open, the EVAP system 300 vents to atmosphere. When configured with the bleed canister element 342, a controller (such as controller 212 of FIG. 2), may actuate the third CVV 344 to a closed position during leak detection, for example, during SHED emission testing. When the EVAP system 300 does not include the bleed canister element 342, the first and the second CVVs 336 and 338, respectively, may be commanded closed during leak detection.

The first and the second canisters 306, 308 are further selectively coupled to a fuel tank 346 via a load line 348. The fuel tank 346 includes a fuel tank pressure sensor (FTPT) 350 to measure pressure of the fuel tank and the at least one canister of the first canister and the second canister coupled to the fuel tank. The load line 348 is bifurcated at a third node 347 and has a balance valve 352 arranged at the third node 347 relative to a direction of fuel vapor flow, as shown by arrow 354. A first load branch 356 of the load line 348 couples the first canister 306 to the fuel tank 346 at a first load port 360 and a second load branch 358 of the load line 348 couples the second canister 308 to the fuel tank 346 at a second load port 362. The first and the second canisters 306, 308 are selectively coupled to the fuel tank 346 using the balance valve 352. The balance valve 352 may be a three-way VBV, in one example. The three-way VBV 352 may be used similarly to the FTIV 252 of FIG. 2 to direct flow between parallel first and second canisters, as further described below.

The first and the second canisters 306, 308 may be arranged in parallel in the EVAP system 300, as described above, which may allow an equal amount of air to flow through each of the first and second vent branches 328, 332, and an equal amount of fuel vapor to flow through each of the first and the second purge branches 312, 316 and the first and the second load branches 356, 358. Branches and regions of the purge line 304, the vent line 324, and the load line 348 may be sized such that a total length of the purge line 304, the vent line 324, and the load line 348 are similar in diameter and length. However, as described above, fuel vapor canisters may become restricted such that symmetric canisters, for example, canisters with the same load capacity, as is the case for the first and the second canisters 306, 308, may have different resulting capacities. To subject each of the first and the second canisters 306, 308 to equal fuel vapor loads during canister purging, flow among the first and the second canisters 306, 308 is adjusted to increase flow through a higher loaded (e.g., more restricted) canister. Flow may be adjusted by actuation of valves in the EVAP system 300, including the first CVV 336, the second CVV 338, and the VBV 352. Each of the first and the second CVVs 336, 338 are actuatable by a vehicle control system, such as the control system 190 of FIG. 1 and the control system 214 of FIG. 2. Upon actuation, the first CVV 336 may be adjusted between a first position or a second position. Upon actuation, the second CVV 338 may be adjusted between a third position or a fourth position. In one example, the first and the third positions are an open position (e.g., on) and the second and the fourth positions are a closed position (e.g., off). When in the open position, each CVV may couple a respective canister to the vent line 324. When in the closed position, the CVV may isolate the respective canister from the vent line 324. The first and the second CVVs 336, 338 may be independently actuated such that the first CVV 336 may be adjusted to the first or the second position when the second CVV 338 is in the third or the fourth position. Similarly, the second CVV 338 may be adjusted to the third or fourth position when the first CVV 336 is in the first or the second position. When the first CVV 336 or the second CVV 338 is in the closed position (e.g., the second or fourth position, respectively), the respective canister may be isolated from the vent line 324.

The three-way VBV 352 may be used to adjust flow of fuel vapor through the load line 348 by coupling the first canister 306 to the fuel tank 346 when the VBV 352 is in a first position, coupling the second canister 308 to the fuel tank 346 when the VBV 352 is in a second position, and coupling both the first and the second canisters 306, 308 to the fuel tank 346 when the VBV 352 is in a third position. The third position in which both the first canister 306 and the second canister 308 are in communication with the fuel tank 346 may be the default position of the VBV 352. By isolating the first or the second canisters 306, 308 from the fuel tank 346 when the VBV 352 is in the second or the first position, respectively, the isolated canister is blocked from backflow of fuel vapor into the respective load port (e.g., the first load port 360 of the first canister 306 or the second load port 362 of the second canister 308).

When the VBV 352 is commanded on, for example, by the controller, the VBV 352 may control flow path via mechanical means, such as springs, in one example. Commanding the VBV 352 on may also be considered as unlocking the VBV, such that the mechanical mechanism of the VBV 352 is able to move and open to one of the first, second, and third positions. For a path with higher flow (e.g., a larger pressure drop between the fuel tank 346 and the respective canister of the first or the second canisters), the VBV, when configured as a spring-loaded valve, may open to a position of the first, the second, and the third position that results in a lower pressure drop. For example, when pressure of the first canister is higher than pressure of the second canister, the VBV is in the second position, coupling the second canister 308 to the fuel tank 346. When the VBV 352 is off, the VBV may be locked in the present position (e.g., the first, second, or third positon as described above), such that the VBV may not adjust to a different position of the first, second, and third positions.

Blocking backflow of fuel vapor into the isolated canister of the first and the second canisters 306, 308 may reduce unequal loading of fuel vapors into the first and the second canister. Unequal loading of fuel vapors may result in a disproportionately higher level of fuel vapor being loaded into what would be the isolated canister, in an example where the VBV is omitted, which may result in one of the first and the second canisters being more restricted (e.g., having a higher load) than the other. Further examples of issues that may arise when the VBV 352 is omitted from the evaporative emissions control system are depicted in FIG. 4.

FIG. 4 shows a second example EVAP system 400 including two parallel fuel vapor canisters and canister vent valves with a balance valve, such as the VBV 352 of FIG. 3, omitted. The EVAP system 400 may include similar elements as the EVAP system 300 of FIG. 3, which are labeled similarly in FIG. 4, and will not be reintroduced for brevity.

In the EVAP system 400, the vent line 324 is coupled to a dust box 402, which may filter particles from atmospheric air drawn into the EVAP system 400 in a direction indicated by solid arrow 406. In the example of FIG. 4, the first CVV 336 is closed and the second CVV 338 is open, thus the first canister 306 is isolated from the vent line 324, and therefore from the atmosphere, and the second canister 308 is coupled to the vent line 324. Positioning (e.g., open or closed) of the first and the second CVVs 336, 338 may be an example of EVAP system 400 during canister purging and measuring restriction of the second canister 308, as further described below.

Air drawn in from the atmosphere through the dust box 402 flows through the vent line 324 and along the second vent branch 332, as indicated by solid arrows 406. Air flows into the second canister 308 via the second vent port 334 and a mixture of air and fuel vapors (e.g., fuel vapors trapped by the canister) flow out of the second canister 308 via the second load port 362 and the second purge port 318. Air flows through the second purge port 318 to the purge line 304 via the second purge branch 316, as shown by solid arrows 406. In this way, fuel vapor trapped by the second canister 308 is purged from the second canister 308 to an engine system, such the engine system 208 of FIG. 2.

Air and fuel vapor flow out of the second canister 308 through the second load port 362 as shown by the dashed arrows 408. The air and fuel vapor mixture flows to the load line 348 via the second load branch 358, continues on to the first load branch 356, and flows into the first canister 306 via the first load port 360. As the first CVV 336 is in the closed position, thus blocking flow to the atmosphere via the vent line 324, the air and fuel vapor mixture flows out of the first canister 306 via the first purge port 314 to the first purge branch 312 and to the engine system. However, fuel vapors trapped by the first canister 306 may not be purged when the air and fuel vapor mixture from the second canister 308 flow through the first canister 306. In one example, fuel vapor from the air and fuel vapor mixture purged from the second canister 308 may become trapped in the first canister 306, further restricting the first canister 306.

Returning to FIG. 3, inclusion of the three-way VBV 352 may prevent backflow during canister purging and restriction flow measurement. When in the first position, the VBV 352 couples the first canister 306 to the fuel tank 346, blocking backflow to the second canister 308. When in the second position, the VBV 352 couples the second canister 308 to the fuel tank 346, blocking backflow to the first canister 306.

When configured with n fuel vapor canisters (e.g., n is more than 2), the EVAP system 300 may include, for each canister, a CVV selectively coupling each of the n number of canisters to the atmosphere via a vent line, where the vent line may be branched such that each of n number of branches of the vent line is connected to a single canister of the n canisters with a single CVV positioned thereon, and the n number of branches may merge at a single branch point to combine flow from each of the n number of canisters to the atmosphere. In this way, an EVAP system with n number of canisters has n number of CVVs and n number of branches of the branched vent line, where the number of canisters, the number of CVVs, and the number of vent line branches are equal.

Additionally, the balance valve used to adjust flow may be configured as a n-way balance valve with n+1 positions (e.g., if n=3, the n-way balance valve may have four positions). For example, when configured with three canisters, each canister is coupled with a canister vent valve positioned on a branch of a vent line to selectively couple the respective canister to the atmosphere, for a total of three CVVs. The VBV may be configured as a four-way balance valve to selectively couple a first canister to the fuel tank when in a first position, a second canister to the fuel tank when in a second position, or a third canister to the fuel tank when in a third position. A default position (e.g., a fourth position) of the four-way balance valve couples all of the three canisters to the fuel tank. For different values of n, the n-way balance valve may similarly be configured to couple one of n number of canisters to the fuel tank for each of n positions of the balance valve and to couple all of the n number of canisters to the fuel tank when in a default position.

A second purge line with a second CPV positioned thereon may be included in the EVAP system 300 when configured with n fuel vapor canisters to selectively couple at least one of the n number of canisters to the intake manifold. Canister purging operation of the EVAP system configured with n canisters may be conducted as described above in FIG. 3 and as further described in FIGS. 5-6, 8-9.

For an EVAP configured with two canisters, such as the EVAP 300, during canister purging, adjustment of the first CVV and the second CVV, and actuation of the VBV to adjust flow among the first and the second canisters is dependent on restriction or load of the first and the second canisters. As described above, the first and the second canisters may be symmetrical, that is, the first and the second canisters may be manufactured with the same volumetric capacity for trapping and purging fuel vapors. Fuel vapor canisters also have inherent restrictions that may vary among canisters of the same capacity. For example, carbon pellets in the canisters used to trap fuel vapors may restrict flow more in one canister compared to another canister, which may be a result of the carbon pellets having trapped more fuel vapors. As canister restriction may change over time, adjusting flow among the first and the second canisters includes regularly determining restriction of the first and the second canisters based on pressure of the purge line when the first or the second canister is isolated from the other of the first or the second canister. Adjusting flow among the first and the second canisters based on canister restrictions further includes using the first CVV, the second CVV, and the VBV to direct flow through the first and/or the second canisters. Once restriction of the first and the second canisters has been determined, a first duty cycle of the first CVV and a second duty cycle of the second CVV may be learned to determine an amount of time each of the first and the second CVV are to be in the open position during canister purging. As canister restriction may change over time, so may the duty cycles of CVVs used to adjust flow to increase flow through a higher loaded/more restricted canister. In one example, regularly determining canister restriction and learning CVV duty cycles includes repeating methods further described in FIGS. 5-6, 8 after each of a quantity of driving miles. Once canister restrictions have been measured and duty cycles have been learned, canister purging may be initiated to purge fuel vapors trapped by the canisters to the engine, as described in FIG. 9.

Figure 5:
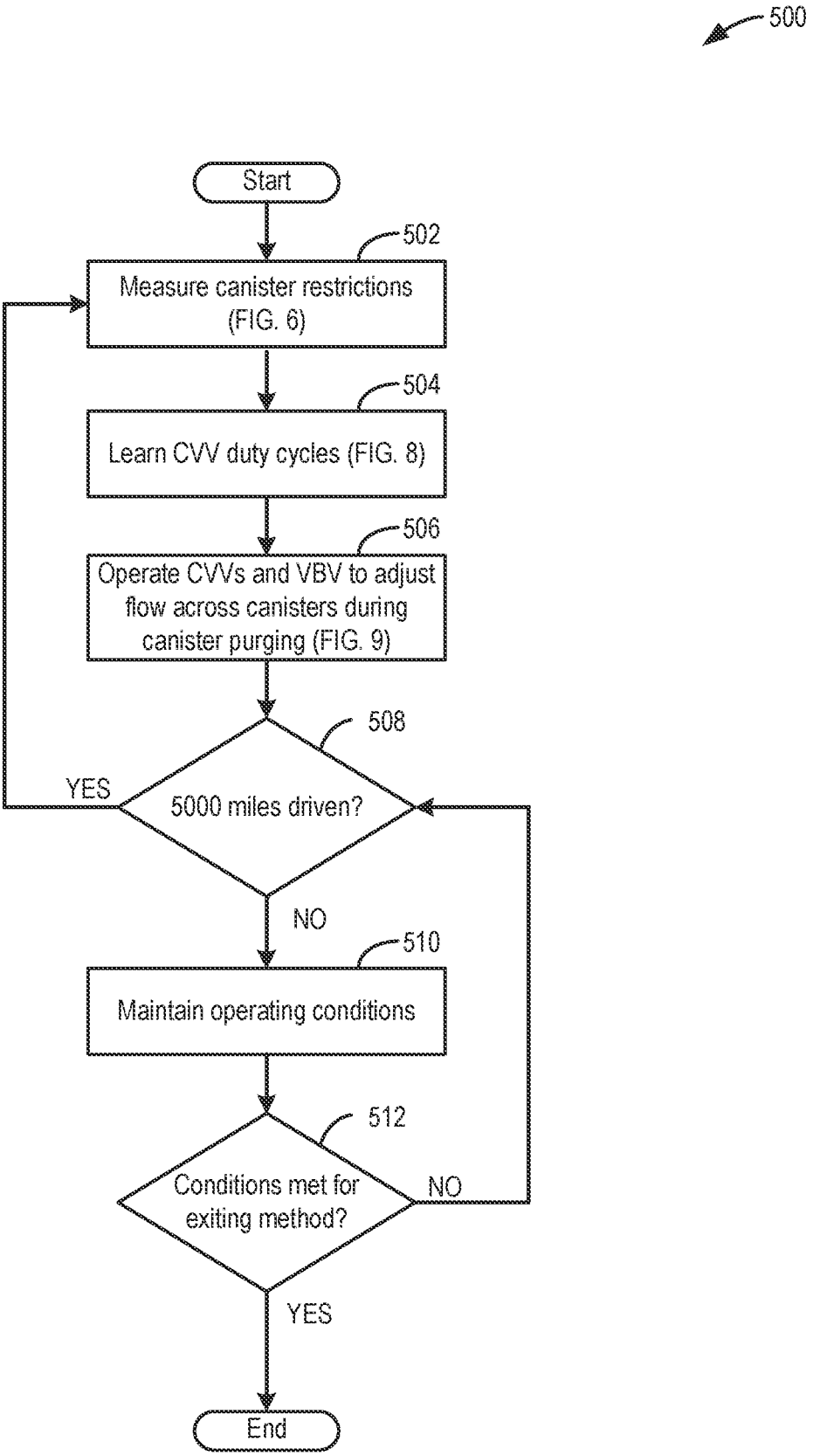
FIG. 5 shows an example method for adjusting flow through dual parallel canisters, as may be included in the first and second EVAP systems of FIGS. 3-4.

FIG. 5 shows an example high-level method 500 for adjusting flow through dual parallel canisters based on canister load using two CVVs and a VBV, for example, as shown in FIG. 3, such that flow through a canister with a higher load is increased. Method 500 may be applied to an EVAP system during nominal engine operation, and may be executed while driving. For example, method 500 may be implemented while the vehicle is driving to learn canister restriction as conditions during vehicle idle may inaccurately represent canister load of the first canister and the second canister. Instructions for carrying out method 500 and the rest of the methods included herein may be executed by a controller based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below. Method 500 and the rest of the methods included herein may be applied to the EVAP system 300 of FIG. 3. Method 500 and the rest of the method included herein may also be applied to the EVAP system 300 configured with n number of canisters and respective elements, such as canister vent valves, as described above.

At 502, method 500 includes measuring canister restrictions, which includes measuring a first restriction of a first canister and a second restriction of a second canister of the dual parallel canisters. Further detail regarding measuring canister restrictions is described in FIG. 6. Method 500 proceeds to 504. At 504, method 500 includes learning CVV duty cycles, including learning a first duty cycle for a first CVV of the two CVVs, the first CVV controlling flow to the first canister, and a second duty cycle for a second CVV of the two CVVs, the second CVV controlling flow to the second canister. Further details regarding learning CVV duty cycles are described in FIG. 8. At 506, method 500 includes operating the first CVV, the second CVV, and the VBV to adjust flow across canisters during canister purging. This may include duty cycling the first and the second CVVs based on the CVV duty cycles learned at 504. Additionally, the VBV may be in either the first, second, or third positions, as described above, to direct flow during canister purging. Further details regarding canister purging is described in FIG. 9.

At 508, method 500 includes determining whether 5000 miles have been driven by the vehicle. If, at 508, 5000 miles have been driven, method 500 returns to 502, where method 500 includes measuring canister restrictions for the first and the second canister, as restriction of the first canister and restriction of the second canister may have changed since the last measurement of canister restrictions, for example, due to buildup of fuel vapors in the canisters during engine operation.

If at 508, 5000 miles have not been driven, method 500 proceeds to 510. At 510, method 500 includes maintaining operating conditions. At 512, method 500 includes determining if conditions have been met for exiting method 500. Conditions for exiting method 500 may include a stabilized fuel tank pressure at a steady state vehicle speed, in one example. Conditions for exiting method 500 may further reduce noise from fuel slosh in a FTPT signal, such as the FTPT of FIG. 3. If at 512, it is determined that conditions have been met for exiting method 500, method 500 ends. If at 512 it is determined that conditions for exiting method 500 have not been met, method 500 returns to 508, where method 500 includes determining if 5000 miles have been driven. Method 500 may cycle through paths of 502-512 and measure restriction of the first and the second canister after each 5000 miles driven during the vehicle lifetime.

Figure 6:
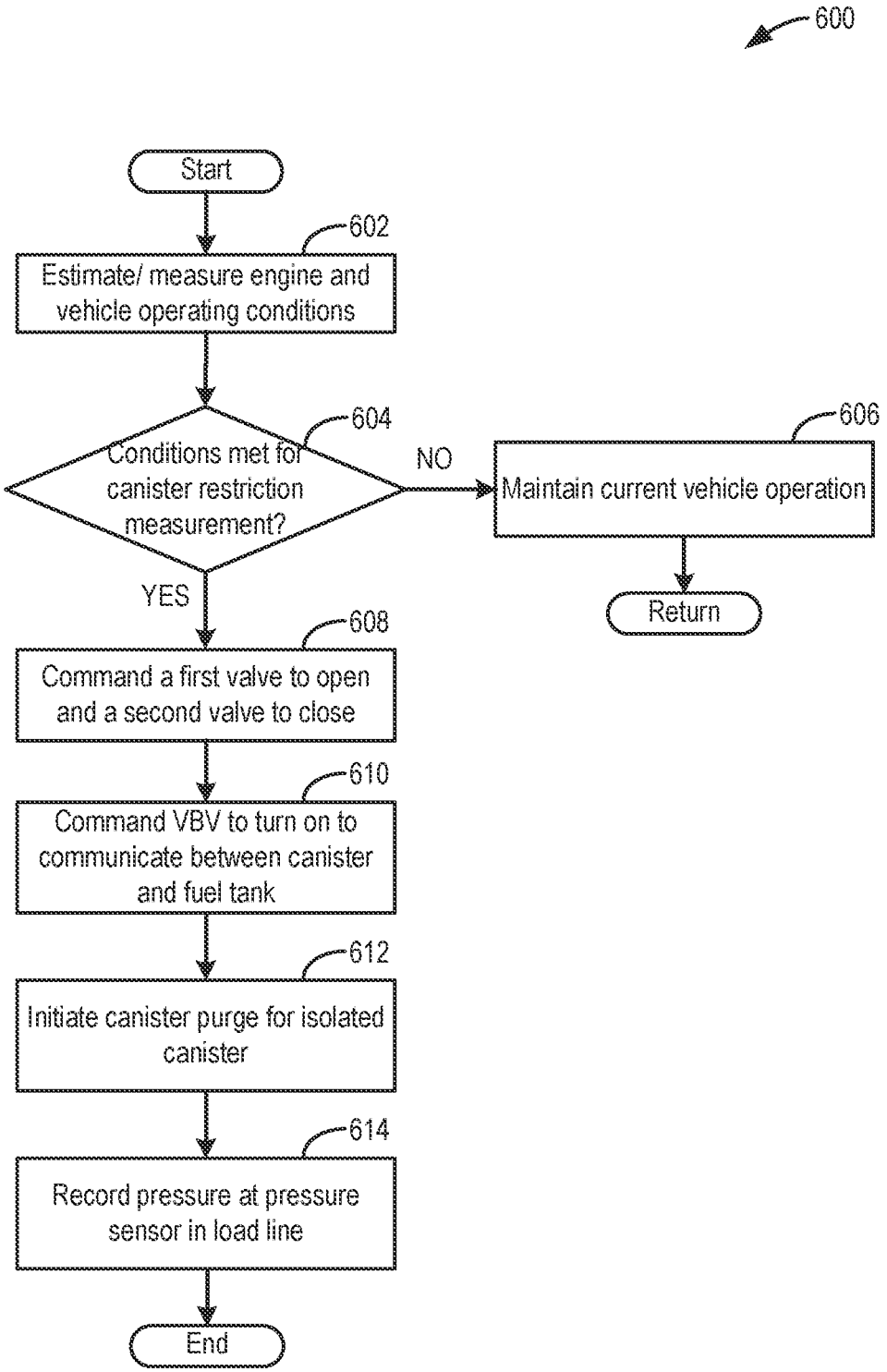
FIG. 6 shows an example method for measuring a canister restriction for a single canister of the dual parallel canisters.
Figure 7A:
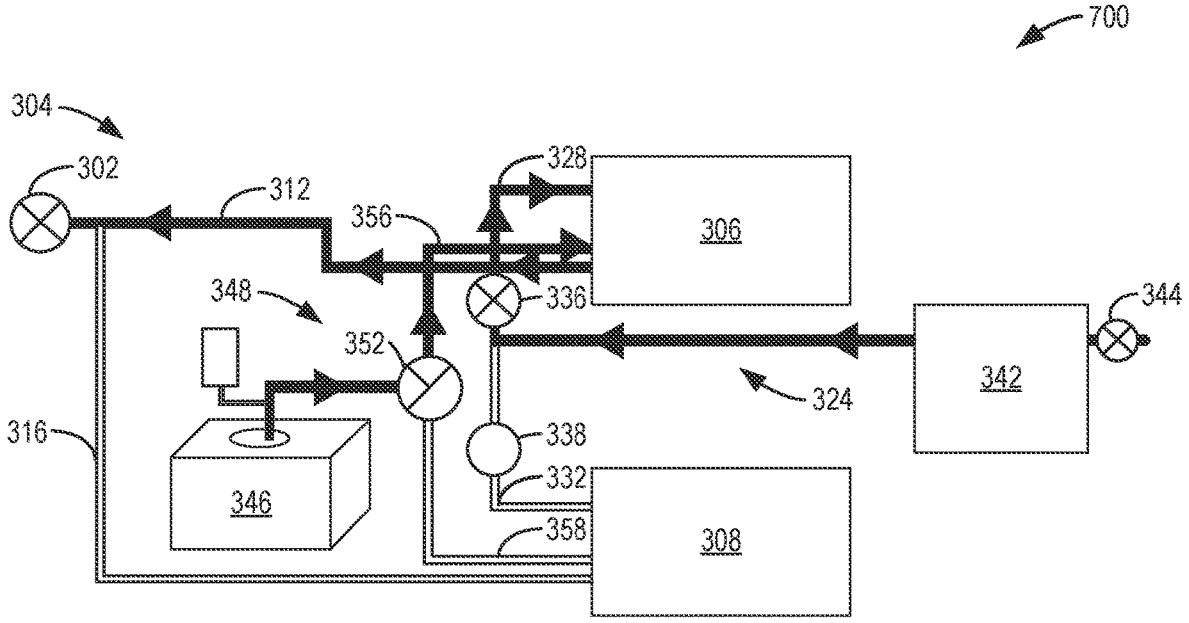
FIG. 7A shows a canister vent valve (CVV) position and a balance valve (VBV) position during measurement of a first canister restriction, according to the method of FIG. 6.
Figure 7B:
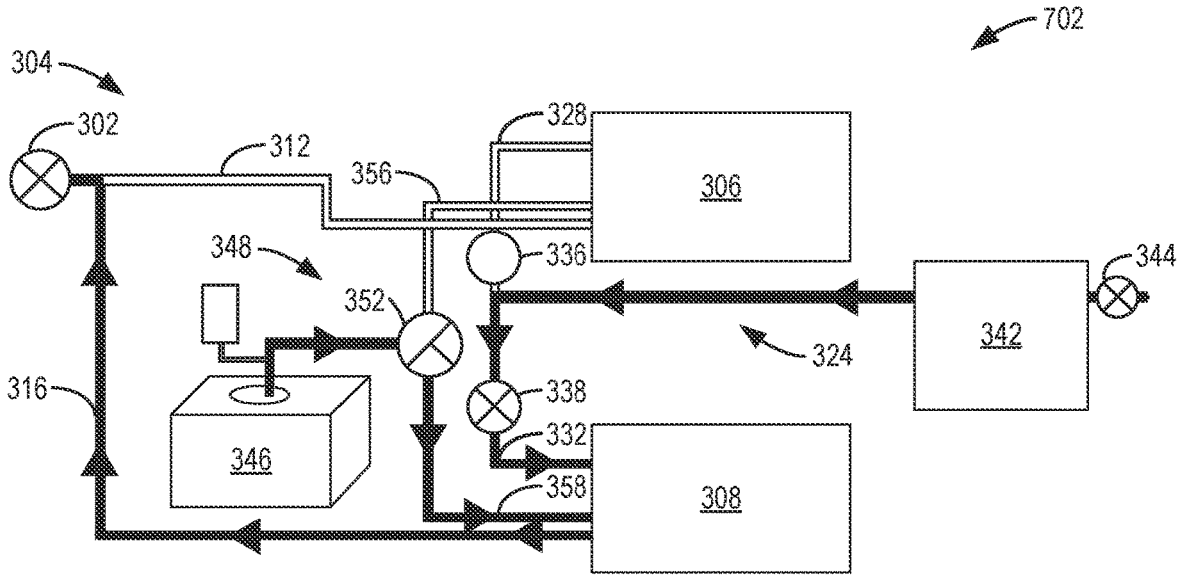
FIG. 7B shows a canister vent valve (CVV) position and a balance valve (VBV) position during measurement of a second canister restriction, according to the method of FIG. 6.

FIG. 6 shows an example method 600 for measuring canister restriction for a single canister. As briefly described above, restriction of the first and the second canisters may be different depending on a load of each of the first and the second canisters. Method 600 may be repeated for both the first and the second canisters.

Method 600 begins at 602, where method 600 includes estimating and/or measuring engine and vehicle operating conditions. Vehicle operating conditions may be estimated based on one or more outputs of various sensors of the vehicle, such as the sensors described above with reference to FIGS. 1-3. Vehicle operating conditions may include engine speed and load, vehicle speed, transmission oil temperature, exhaust gas flow rate, mass air flow rate, coolant temperature, coolant flow rate, engine oil pressures, operating modes of one or more intake valves and/or exhaust valves, electric motor speed, battery charge, engine torque output, vehicle wheel torque, etc. In one example, the vehicle is a hybrid electric vehicle and estimating and/or measuring vehicle operating conditions may further include determining a state of a fuel system of the vehicle, such as a level of fuel in the fuel tank, determining a state of one or more valves of the fuel system (e.g., a canister vent valve, a fuel tank intake valve, a canister purge valve, etc.), and determining an engine operating temperature. For example, when engine coolant is greater than 140° F., the engine may be determined to be at the engine operating temperature and method 600 may proceed.

At 604, method 600 includes determining if conditions are met for performing canister restriction measurement. In one example, the conditions include determining if 5000 miles have been driven by the vehicle since a prior canister restriction measurement, as described in FIG. 5. In another example, if the vehicle is driven during dusty conditions or on bumpy terrain, drive mileage for dusty conditions or on bumpy terrain may be accrued and canister restriction measurement conditions may be met after less driving miles, for example, after 2500 miles if the vehicle is driven in 100% dusty driving conditions. If conditions have not been met for canister restriction measurement, at 606, method 600 includes maintaining current vehicle operation and canister restriction is not measured. Method 600 returns to the start.

If conditions have been met for canister restriction measurement at 604, at 608, method 600 includes commanding a first valve to open and a second valve to close. When measuring restriction of the first canister, the first valve is the first CVV and the second valve is the second CVV. In this way, air may flow into the first canister through the first CVV and air flow to the second canister is blocked by the closed second CVV, as is shown in FIG. 7A, to be further described below. When measuring restriction of the second canister, the first valve is the second CVV and the second valve is the first CVV. In this way, air may flow into the second canister through the second CVV and air flow to the first canister is blocked by the closed first CVV, as is shown in FIG. 7B, to be further described below. At 610, the method 600 includes commanding the VBV to turn on to communicate between the canister being measured and a fuel tank. Turning on the VBV may include unlocking a mechanical mechanism, allowing the VBV to adjust between a first, a second, and a third position based on pressure differences in each of the paths to the first and/or the second canisters. For example, when measuring restriction of the first canister, the VBV is in the first position to couple the first canister to the fuel tank, blocking communication between the fuel tank and the second canister to prevent backflow to the second canister, as shown in FIG. 7A. When measuring restriction of the second canister, the VBV is in the second position to couple the second canister to the fuel tank, blocking communication between the fuel tank and the first canister to prevent backflow to the first canister, as shown in FIG. 7B. When either the first or the second canister are coupled to the fuel tank, pressure in a load line may be measured by a FTPT sensor.

At 612, method 600 includes initiating canister purging for the isolated canister. Initiating canister purging may include opening a CPV to communicate a vacuum of an intake manifold to the isolated canister. In examples where the EVAP system includes a bleed canister element and a third CVV, the third CVV is commanded open. When the first canister is isolated by opening the first CVV, closing the second CVV, and directing communication between the first canister and the fuel tank with the VBV in the first position, initiating canister purging may pull air flow in from the atmosphere through a vent line and into the first canister. Additionally, fuel vapors from the fuel tank may be pulled through the load line into the first canister. Air and fuel vapors may flow out of the first canister into a purge line, and to an intake manifold of the engine. When the second canister is isolated by opening the second CVV, closing the first CVV, and directing communication between the second canister and the fuel tank with the VBV in the second position, initiating canister purging may pull air flow in from the atmosphere through the vent line and into the second canister. Additionally, fuel vapors from the fuel tank may be pulled through the load line into the second canister. Air and fuel vapors may flow out of the second canister into the purge line and to the intake manifold.

At 614, method 600 includes recording a pressure at a pressure sensor positioned in the load line, for example, FTPT 350 of FIG. 3. For measuring restriction of the first canister, pressure in the purge line may be recorded as Pr1. For measuring restriction of the second canister, pressure in the purge line may be recorded as Pr2. Method 600 ends.

When method 600 is applied to an EVAP system with n number of canisters, n number of CVVs, and a n-way VBV (e.g., n=3, n-way VBV having n+1 positions), restriction of each of the n number of canisters may be similarly measured compared to measuring restriction of two canisters. For example, at 608, method 600 includes closing all CVVs of the n number of CVVs except for a CVV of a canister of the n number of canisters to be measured. At 610, method 600 includes commanding the VBV on to communicate between the canister to be measured and the fuel tank. At 612, method 600 includes initiating canister purge for the isolated canister and at 614, method 600 includes recording pressure of the isolated canister at the pressure sensor of the load line. Method 600 may be repeated to measure restriction of each of the n number of canisters.

In this way, canister restriction is measured for the at least two canisters. Positions (e.g., open/closed) of the first and the second CVV as well as the VBV (e.g., first, second, or third position) for the first and the second canister restriction measurements according to the method 600 are shown in FIGS. 7A-B, respectively. For example, the EVAP system 300 of FIG. 3 is shown in a first configuration 700 in FIG. 7A and in a second configuration 702 in FIG. 7B. Elements of the EVAP system 300 are labeled similarly in FIGS. 7A-7B and are not reintroduced for brevity. Solid lines and arrows in both FIGS. 7A-B show flow through the EVAP system 300.

The first configuration 700 of FIG. 7A may be used for restriction measurement of the first canister 306, where the first CVV 336 is open, the second CVV 338 is closed, the CPV 302 is open, and the third CVV 344 is open. The VBV 352 is in the first position coupling the fuel tank 346 to the first canister 306. Air flows in from the atmosphere through the vent line 324, via the bleed canister element 342 and the third CVV 344, when included in the first configuration 700. Air flow then continues through the open first CVV 336 through the first vent branch 328 and into the first canister 306. Additionally, fuel vapors from the fuel tank 346 flow into the first canister 306 via the load line 348, passing through the VBV 352 in the first position. Air and fuel vapors in the first canister 306 flow out of the first canister to the intake manifold via the first purge branch 312.

In FIG. 7B, showing EVAP system configuration used for restriction measurement of the second canister, the second CVV 338 is open, the first CVV 336 is closed, the CPV 302 is open, and the third CVV 344 is open. The VBV 352 is in the second position coupling the fuel tank 346 to the second canister 308. Air flows in from the atmosphere through the vent line 324, via the bleed canister element 342 and the third CVV 344 when included in the second configuration 702. Air flow then continues through the open second CVV 338 through the second vent branch 332 and into the second canister 308. Additionally, fuel vapors from the fuel tank 346 flow into the second canister 308 via the load line 348, passing through the VBV 352 in the second position. Air and fuel vapors in the second canister 308 flow out of the second canister to the intake manifold via the second purge branch 316.

Once restriction of the first and the second canisters are measured using method 600, pressure Pr1, which indicates a restriction level of the first canister, and pressure Pr2, which indicates a restriction level of the second canister, are used to learn CVV duty cycles for the first and the second CVVs. Pr1 and Pr2 are compared to determine which canister of the first and the second canisters is more restricted/has a greater load, or if the first and the second canisters are equally restricted. A duty cycle is learned for the CVV of the less restricted canister. The duty cycle may be a duration for which a valve (e.g., the first or the second CVV) is opened to allow a first pressure to equal a second pressure, for example, how long the second CVV is opened for Pr2 to equal Pr1. Learned duty cycles may then be used during canister purging to adjust flow among the first canister and the second canister to increase flow through the higher loaded/more restricted canister by closing the valve of the less restricted canister prior to the end of a duration of canister purging, e.g., using a shorter duty cycle at the CVV of the less restricted canister.

Figure 8:
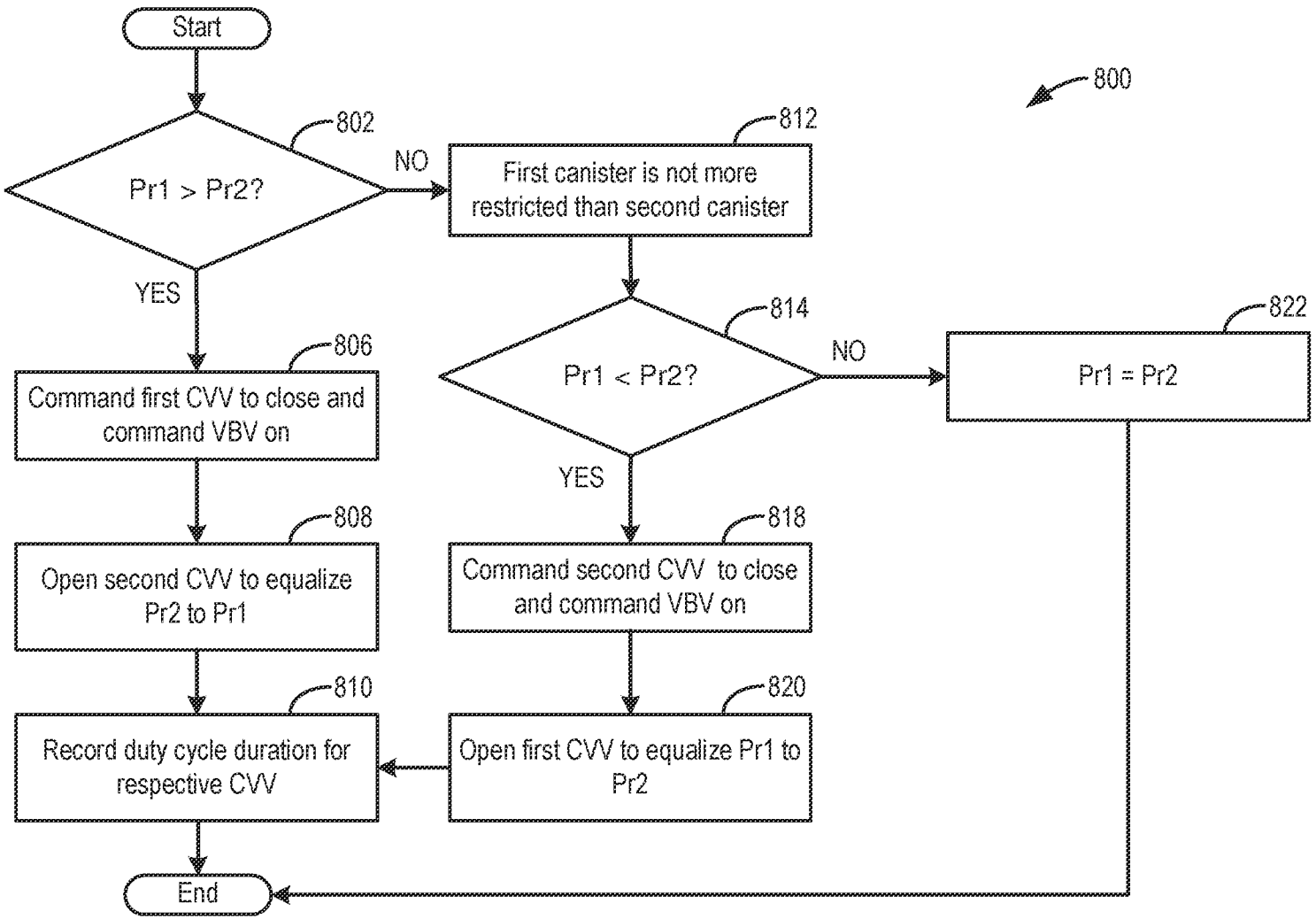
FIG. 8 shows an example method for learning duty cycles of CVVs.

FIG. 8 shows an example method 800 for learning a first duty cycle and a second duty cycle for the first and the second CVVs, respectively. Learning the first and the second duty cycles may include determining a first duration of the first duty cycle and a second duration of the second duty cycle, and storing the first and the second durations as the first and the second duty cycles, respectively, on a memory of a controller. The learned first and second duty cycles may be used during canister purging, as will be further described in FIG. 9.

Method 800 may include learning the first and the second duty cycles using pressure Pr1, indicating restriction of the first canister, and pressure Pr2, indicating restriction of the second canister, as measured using method 600.

Method 800 starts at 802. At 802, Pr1 is compared to Pr2 to determine whether Pr1 is greater than Pr2. For example, Pr1 may be greater than Pr2 if pressure recorded during restriction measurement of the first canister is greater than pressure recorded during restriction measurement of the second canister. If it is determined at 802 that Pr1 is greater than Pr2, the first canister is more restricted than the second canister (e.g., has a greater load). In other words, greater restriction results in a greater pressure drop and no restriction results in no pressure drop.

At 806, method 800 includes commanding the first CVV to close, thus blocking the first canister from taking in air from the atmosphere. The VBV is commanded on and adjusts to the second position due to a higher pressure drop between the fuel tank and the second canister compared to between the fuel tank and the first canister, coupling the fuel tank to the second canister, as described in FIG. 3. At 808, method 800 includes opening the second CVV for a second duration to equalize pressures Pr1 and Pr2. Additionally, the CPV is opened to couple the EVAP system to the engine intake manifold and, in the EVAP system including the bleed canister element and the third CVV, the third CVV is opened to couple the EVAP system to the atmosphere. In one example, opening the second CVV and using the VBV to direct air and fuel vapor flow to the second canister increases pressure Pr2 until Pr2 is equal to Pr1, then the second CVV is closed. Pr2 may be measured by a pressure sensor positioned on the load line (e.g., pressure sensor 350 of FIG. 3). The second duration is recorded as the second duty cycle for the second CVV at 810, and method 800 ends.

Returning to 802, if Pr1 is not greater than Pr2, method 800 proceeds to 812. At 812, it is deduced from Pr1 not being greater than Pr2 that the first canister is not more restricted than the second canister. As a result of it being deduced that the first canister is not more restricted than the second canister, method 800 proceeds to 814. At 814, method 800 includes determining whether Pr1 is less than Pr2. If Pr1 is less than Pr2, the second canister is more restricted than the first canister. If Pr1 is less than Pr2, method 800 proceeds to 818. At 818, method 800 includes commanding the second CVV to close, thus blocking the second canister from taking in air from the atmosphere. The VBV is commanded on, as described in FIG. 3, whereby the VBV is adjusted to the first position due to a higher pressure drop between the fuel tank and the first canister compared to between the fuel tank and the second canister, coupling the fuel tank to the first canister. At 820, the first CVV is opened for a first duration to equalize Pr2 and Pr1. Additionally, the CPV is opened to couple the EVAP system to the engine intake manifold and, in the EVAP system including the bleed canister element and the third CVV, the third CVV is opened to couple the EVAP system to the atmosphere. In one example, opening the first CVV and using the VBV to direct air and fuel vapor flow to the first canister increases pressure Pr1 until Pr2 is equal to Pr1, and the first CVV is closed. Pr1 may be measured by the pressure sensor positioned on the load line. The first duration is recorded as the first duty cycle for the first CVV at 810, and method 800 ends.

As one example, Pr1 may be greater than Pr2. When the EVAP system is unrestricted, Pr1 and Pr2 are in the range of −2 to −6 in$H_2O$ and when at least one canister of the EVAP system is restricted, Pr1 and Pr2 may be less than −6 in$H_2O$. As a result of Pr1 being greater than Pr2, it may be deduced that the first canister is more restricted than the second canister. Alternatively, in another example, Pr1 may be less than Pr2. As a result of Pr1 not being greater than Pr2, it may be deduced that the second canister is more restricted than the first canister. In this way, a difference between Pr1 and Pr2 may be used to determine whether a greater restriction exists in the first canister or the second canister.

If Pr1 is greater than Pr2, learning the second duty cycle includes closing the first CVV and commanding the VBV on, such that the VBV may allow communication between the fuel tank and the second canister. The second CVV is opened, the CPV is opened, and, when included, the third CVV is open. In this way, vacuum from the intake manifold of the engine may pull air and fuel vapor through the second canister. Pressure of the second canister (e.g., Pr2) increases until Pr2 equals Pr1 (the value of Pr1 as determined by method 600). A duration for which the second CVV is open for Pr2 to equal Pr1 is recorded as the second duty cycle. In one example, the second duty cycle is 10 Hz.

If Pr1 is not greater than Pr2, learning the first duty cycle includes closing the second CVV and commanding the VBV on, such that the VBV may allow communication between the fuel tank and the first canister. The first CVV is opened, the CPV is opened, and, when included, the third CVV is open. In this way, vacuum from the intake manifold of the engine may pull air and fuel vapor through the first canister. Pressure of the first canister (e.g., Pr1) increases until Pr1 equals Pr2 (the value of Pr2 as determined by method 600). The duration for which the first CVV is open for Pr1 to equal Pr2 is recorded as the first duty cycle. In one example, the first duty cycle is 10 Hz. The first duty cycle and the second duty cycle may have different durations.

Returning to 814, if Pr1 is not less than Pr2, method 800 proceeds to 822. At 822, it may be deduced that Pr1 and Pr2 are equal, meaning the first and the second canisters are equally restricted. As a result of determining that the first canister and the second canister are equally restricted, the first and the second duty cycles are not learned, as duty cycling (e.g., opening the CVV for the duration of the learned duty cycle) of the first and the second CVV may not be implemented during canister purging, as further described in FIG. 9. Method 800 ends.

When method 800 is applied to an EVAP system with n number of canisters, n number of CVVs, and a n-way VBV, a duration of a respective duty cycle for each of n number of CVVs may be similarly measured compared to measuring restriction of two canisters. Pressures recorded using method 600 may be compared between the n number of canisters to determine relative canister restrictions. For example, if one canister of the n number of canisters is determined to be more restricted than at least two canisters of the n number of canisters, method 800 may be applied to equalize pressure of the two less restricted canisters to a pressure of the more restricted canister. At 806, method 800 may include commanding the CVV of the more restricted canister of the n number of canisters closed and commanding the VBV on. At 808, method 800 may include opening the CVVs of the less restricted canisters of the n number of canisters to equalize pressure of the less restricted canisters to the pressure of the more restricted canister. The VBV may be in a position that allows for communication between the fuel tank and the less restricted canisters. At 810, method 800 includes recording duty cycle durations for the CVVs of the less restricted canisters, where each CVV may have a different duty cycle duration.

In another example, at 808, method 800 may include opening the CVV of one less restricted canisters, when two or more canisters of the n number of canisters are less restricted than the more restricted canister. As the two or more less restricted canisters may not have equal restrictions, steps 808-810 of method 800 may be sequentially applied to the two or more less restricted canisters to individually determine respective CVV duty cycles. In this way, the first duty cycle and the second duty cycle for the first and the second CVVs, respectively, are learned using Pr1 and Pr2, which compares a restriction of the first canister with a restriction of the second canister. Learned duty cycles may be used during canister purging to adjust flow among the first and the second canisters to increase flow through a more restricted canister by directing the CVV of the less restricted canister to open for the duration of the respective duty cycle, such that flow is equalized between the canisters, e.g., the canisters undergo equal purging relative to their respective amount of restriction.

Figure 9:
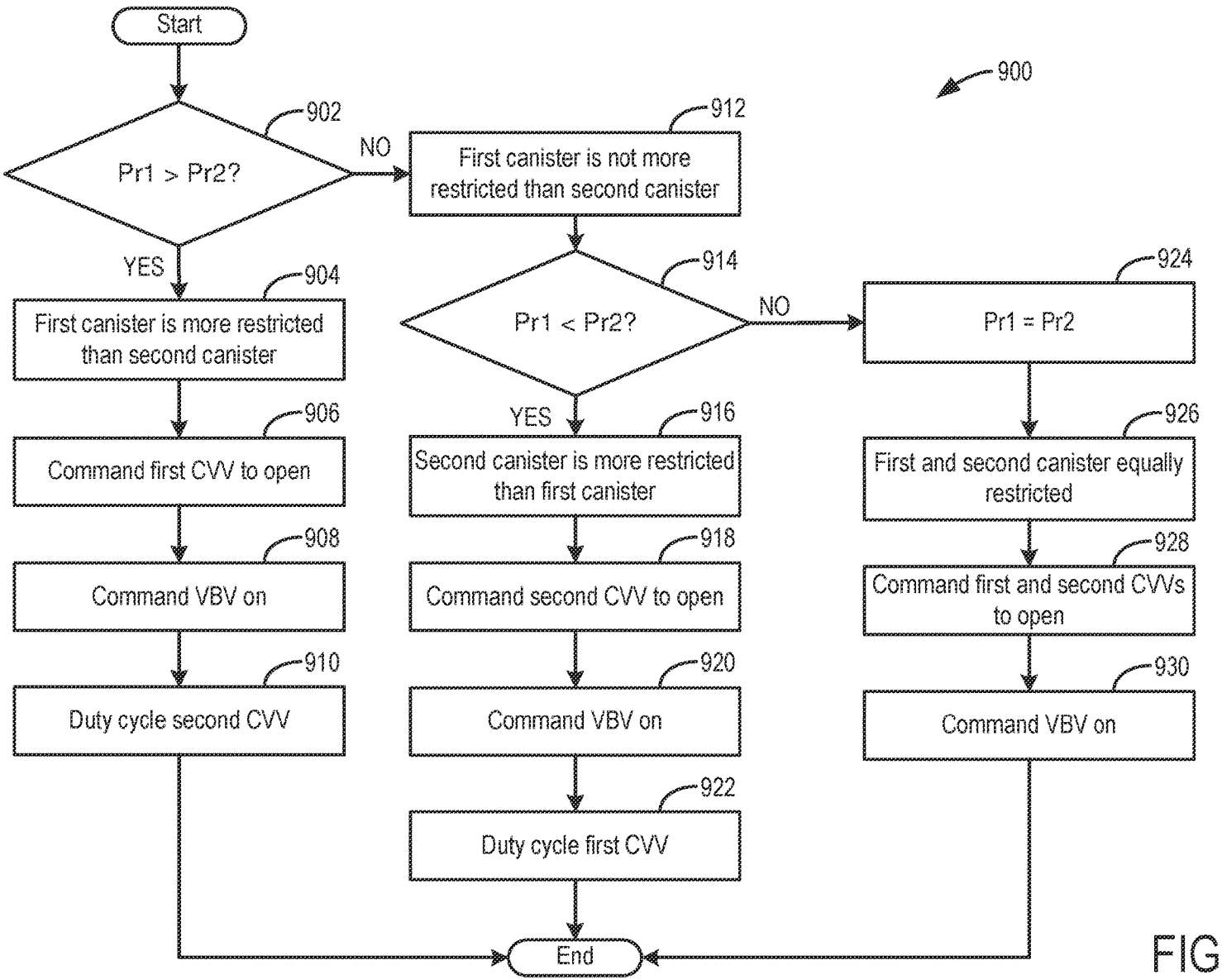
FIG. 9 shows an example method for canister purging.
Figure 10:
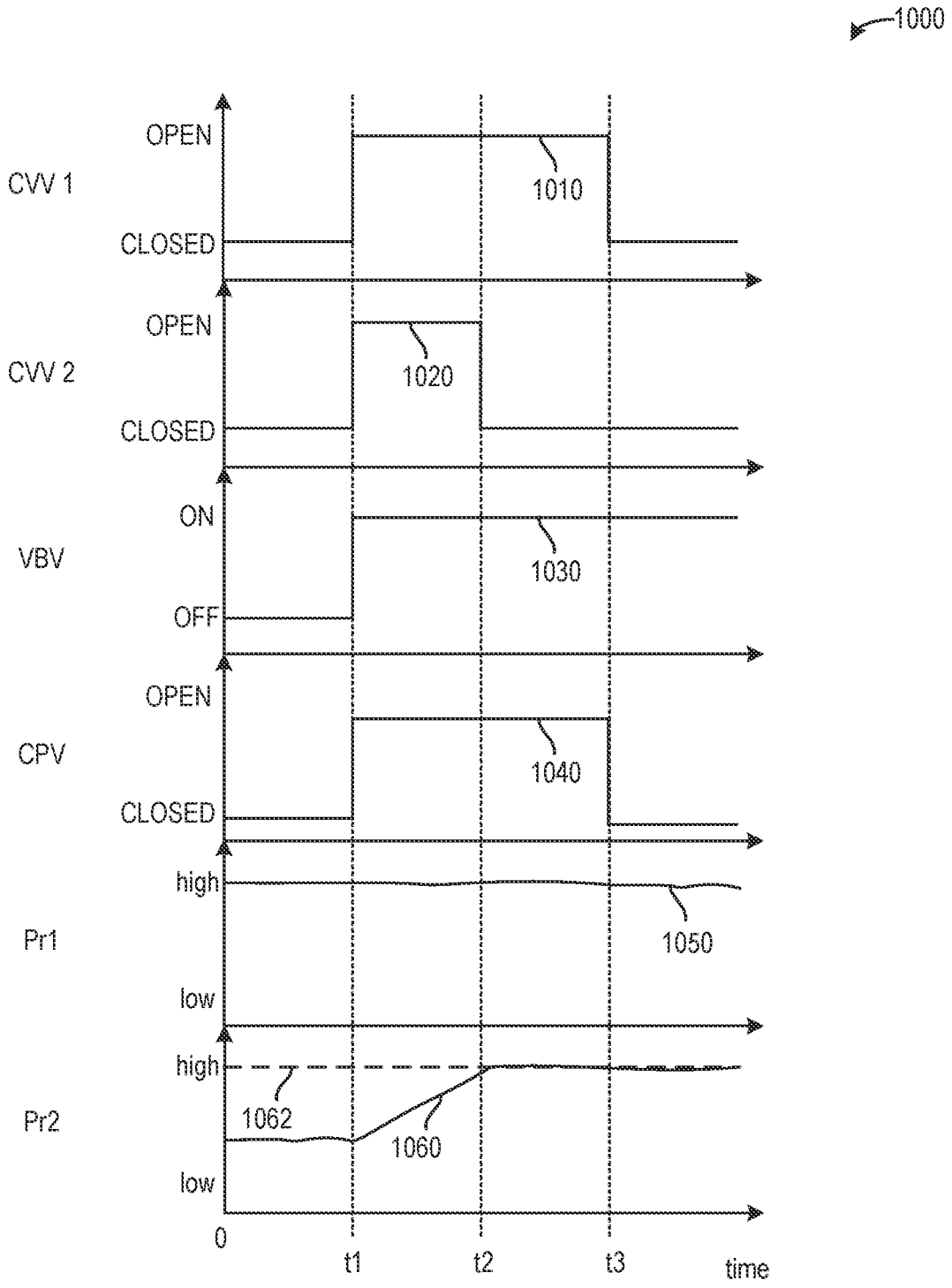
FIG. 10 shows an example canister purging sequence according to the method of FIG. 9.

FIG. 9 shows an example method 900 for canister purging for the first and the second canisters, where the first and the second CVVs of the first and second canisters, respectively, may be opened for the duration of the respective first or second duty cycle as determined in method 800. Which of the first or the second CVVs to open for the respective duty cycle duration compared to a duration of canister purging is determined based on relative restriction of the first and the second canisters. Opening the first and the second CVVs for different durations based on relative restriction of the first and the second canisters adjusts flow among the canisters during canister purging and increases flow through the more restricted canister. Method 900 begins at 902 by confirming if Pr1 is greater than Pr2. As described in FIG. 6, Pr1 indicates restriction of the first canister and Pr2 indicates restriction of the second canister. If Pr1 is greater than Pr2, the first canister is more restricted than the second canister at 904, and method 900 proceeds to adjust flow during canister purging by adjusting the first and the second CVV positions and turning on the VBV so that increased flow may be directed through the first canister relative to the second canister. Canister purging includes opening the CPV to fluidically couple the first and the second canisters to the intake manifold, allowing purged fuel vapors to be used by the engine as fuel. At 906, the first CVV is commanded open to couple the first canister to the atmosphere via the vent line. The first CVV remains open for the duration of canister purging. The VBV is commanded on (e.g., mechanical mechanism is unlocked) at 908 to communicate between the second canister and the fuel tank. At 910, the second CVV is opened for the duration of the second duty cycle. Opening the second CVV for the duration of the second duty cycle allows pressure of the second canister to increase to equal pressure of the first canister, as determined by the method 800. With the first CVV open for the duration of canister purging and the second CVV open for the duration of the second duty cycle, where the duration of the second duty cycle is less than the duration of canister purging, air flows into the second canister and the first canister via the vent line. After the duration of the second duty cycle, the second CVV closes, isolating the second canister. Air flow may then be directed solely to the first canister (e.g., the more restricted canister) to equally purge the first canister compared to the second canister. Method 900 ends. An example timeline of canister purging events is shown in FIG. 10.

If, at 902, Pr1 is not greater than Pr2, method 900 proceeds to 912, where the first canister is deemed to not be more restricted than the second canister. If, at 914, method 900 determines Pr1 to be less than Pr2, the second canister is found to be more restricted than the first canister at 916, and method 900 proceeds to adjust flow during canister purging by adjusting the first and the second CVV positions and turning on the VBV so that increased flow may be directed through the second canister relative to the first canister. Canister purging includes opening the CPV to fluidically couple the first and the second canisters to the intake manifold, allowing purged fuel vapors to be used by the engine as fuel. Method 900 proceeds to 918, where the second CVV is commanded open to couple the second canister to the atmosphere via the vent line. The second CVV remains open for the duration of canister purging. The VBV is commanded on (e.g., mechanical mechanism is unlocked) at 920 to communicate between the first canister and the fuel tank. At 922, the first CVV opened for the duration of the first duty cycle. Opening the first CVV for the duration of the first duty cycle allows pressure of the first canister to increase to equal pressure of the second canister, as determined by method 800. With the second CVV open for the duration of canister purging and the first CVV open for the duration of the first duty cycle, where the duration of the first duty cycle is less than the duration of canister purging, air flows into the first canister and the second canister via the vent line. After the duration of the first duty cycle, the first CVV closes, isolating the first canister. Air flow may then be directed solely to the second canister (e.g., the more restricted canister) to equally purge the second canister compared to the first canister. Method 900 ends.

If, at 914, Pr1 is not less than Pr2, Pr1 is found to be equal to Pr2 at 924, and the first and the second canisters are confirmed to be equally restricted at 926. At 928, the first and the second CVVs are commanded to open for the duration of canister purging, such that the first and the second canisters are coupled to the atmosphere via the vent line, respectively. At 930, the VBV is commanded on (e.g., mechanical mechanism is unlocked) to couple both the first and the second canisters to the fuel tank. Both the first and the second CVVs may remain open for the duration of canister purging. Method 900 ends.

When method 900 is applied to an EVAP system with n number of canisters, n number of CVVs, and a n-way VBV, canister purging of then number of canisters may be similarly conducted compared to purging of two canisters. For example, a canister determined to be the most restricted of the n number of canisters by comparing the pressures of the n number of canisters (e.g., as determined by method 600) may have a respective CVV commanded open, and the VBV may be commanded on. The CVVs of the less restricted canisters of the n number of canisters may be opened for a duration of a respective duty cycle according to the duty cycles determined by method 800. In one example, all CVVs of less restricted canisters are opened for the duration of the respective duty cycles at the same time. Depending on a duration of the respective duty cycles, the CVVs of the n number of CVVs may be open for different durations. The VBV may be in a position of n number of positions to allow communication between the fuel tank and the canisters of the n number of canisters with an open CVV. When a CVV of a canister closes, the VBV may change positions of the n number of positions to maintain communication between the fuel tank and canisters of the n number of canisters with open CVVs.

FIG. 10 shows an example canister purging sequence 1000 according to the method of FIG. 9, including positions of the first and the second CVVs and the CPV, on/off actuation of the VBV, and restriction of the first and the second canisters as represented by Pr1 and Pr2, respectively. Canister purging sequence 1000 includes a plot 1010, illustrating an open/closed position of the first CVV along the y-axis. A plot 1020 shows an open/closed position of the second CVV along the y-axis and a plot 1030 shows commanding of the VBV on or off along the y-axis. An open/closed position of the CPV is shown along the y-axis of plot 1040. Restriction of the first canister is shown by pressure Pr1 at a plot 1050, where high pressure represents high restriction and low pressure represents low restriction, along the y-axis. Restriction of the second canister is shown by pressure Pr2 at a plot 1060, where high where high pressure represents high restriction and low pressure represents low restriction, along the y-axis. In addition, plot 1060 includes a threshold 1062 which may represent the pressure Pr1 of plot 1050. For all plots 1010-1060, time increases along the x-axis from a left side to a right side of the figure.

Sequence 1000 specifically shows canister purging for an EVAP system where a first canister is more restricted than a second canister and a second CVV of the second canister is opened for the duration of a second duty cycle and a first CVV is opened for the duration of canister purging, to adjust flow through the first and the second canisters to increase flow through the more restricted canister, in this example, the first canister.

Prior to t1, the first CVV, the second CVV, and the CPV are closed, as shown in plots 1010, 1020, and 1040, respectively. The VBV is off, e.g., the mechanical mechanism is locked, as shown in plot 1030. Pressure Pr1 is high as shown by plot 1050 and pressure Pr2 is less than pressure Pr1, as shown by plot 1060 being below threshold 1062. As Pr2 is less than Pr1, the first canister is more restricted than the second canister. Canister purging sequence 1000 therefore illustrates a branch of FIG. 9 that begins at 902 and ends after 910.

At t1, the first CVV is opened, the second CVV is opened, the CPV is opened and the VBV is commanded on (e.g., the mechanical mechanism is unlocked). The mechanism of the VBV may adjust to the third positon (e.g., coupling the first and the second canisters to the fuel tank). Opening the first and the second CVVs couples the first and the second canisters to the atmosphere, respectively. In the example EVAP system 300 of FIG. 3, which includes a canister bleed element and a third CVV, the third CVV is also opened. As canister purging method 900 of FIG. 9 is implemented while the engine is operating, opening the CPV couples the EVAP system to the engine intake manifold and canister purging commences. Pressure Pr2 begins to increase and pressure Pr1 remains high.

At t2, pressure Pr2, shown by plot 1060, reaches threshold 1062 and pressure Pr2 equals pressure Pr1. The second CVV is commanded closed, as the duration of the second duty cycle, determined according to the method of FIG. 8, is a duration it takes for Pr2 to equal Pr1. Closing the second CVV isolates the second canister from the atmosphere and from further purging of the second canister. Due to the change in pressure from closing the second CVV, the mechanism of the VBV may adjust from the third position (e.g., coupling the second and the first canisters to the fuel tank) to the first position (e.g., coupling the first canister to the fuel tank). Purging of the first canister continues with the VBV remaining on and the CPV remaining open.

At t3, the first and the second canisters may be purged and the first CVV and CPV are commanded closed. The VBV may remain on and the mechanical mechanism may adjust among the first, second, and third positions to distribute fuel vapor among the first and the second canisters during engine operation based on canister pressure differences. Pressure of the first canister Pr1 and pressure of the second canister Pr2 are approximately equal. The EVAP system is isolated from the intake manifold of the engine and the atmosphere.

In another example, not shown in sequence 1000, the first CVV may be opened at time t1 at the commencement of canister purging while the second CVV may remain closed until time t2. In this example, the second CVV is also commanded open for the duration of the second duty cycle while the first CVV is opened for the duration of canister purging.

In this way, at least two canisters, arranged in a parallel loading flow direction and unloading flow direction, are purged by adjusting flow among the at least two canisters to increase flow through the higher loaded/more restricted canister during purging. Restriction of the at least two canisters is measured as described in method 600 and as shown in FIGS. 7A and 7B, respectively. Duty cycling of at least two CVVs, each CVV coupled to one canister of the at least two canisters, is learned according to the method 800. Duty cycling of at least one of the at least two CVVs is used during canister purging, as described in method 900, to equalize purging between the at least two canisters by adjusting flow such that flow is increased to the more restricted canister. In one example, duty cycling is similarly performed on the at least one of the at least two CVVs during refueling, which may allow the at least two canisters to be equally loaded. Arranging canisters in parallel reduces back pressure associated with a single large canister, and using the balancing valve as well as a canister vent valve associated with each of the canisters to adjust flow allows for selective and dynamic adjusting of flow for each canister purging event throughout a vehicle lifetime, as canister restrictions may change over time.

The technical effect of using ORVR in heavy duty incompletes is that evaporative emissions, such as fuel vapors, may be recovered by the EVAP system of the vehicle and used as fuel instead of being emitted to the atmosphere and potentially contributing to adverse effects of evaporative emissions on environmental and human health.

The disclosure also provides support for a method for a vehicle, comprising purging at least two canisters arranged in parallel along a loading flow direction and unloading flow direction by adjusting flow among the at least two canisters to increase flow through a higher loaded canister of the at least two canisters during purging of the at least two canisters. In a first example of the method, the flow is adjusted via a n-way pressure balancing valve (VBV). In a second example of the method, optionally including the first example, adjusting flow using the VBV includes commanding the VBV to turn on, and where a first canister of at least two canisters is fluidically coupled to a fuel tank when the VBV is in a first position, a second canister of at least two canisters is fluidically coupled to the fuel tank when the VBV is in a second position, and so on for n number of canisters and n number of VBV positions, and all of the at least two canisters are fluidically coupled to the fuel tank when the VBV is in a third position. In a third example of the method, optionally including one or both of the first and second examples, the flow is adjusted by adjusting relative opening durations of a first canister vent valve (CVV) of a first canister of at least two canisters and a second CVV of a second canister of at least two canisters, and so on for n number of canister vent valves of n number of canisters. In a fourth example of the method, optionally including one or more or each of the first through third examples, a first opening duration of the first CVV is based on a load of the first canister, a second opening duration of the second CVV is based on a load of the second canister, and so on for n number of durations, n number of CVVs, and n number of canisters, and wherein a third opening duration of any of at least two CVVs is a duration of purging of the respective canister of at least two canisters. In a fifth example of the method, optionally including one or more or each of the first through fourth examples, adjusting relative flow using the VBV and n number of CVVs for n number of canisters further includes, when a load of the first canister is greater than a load of at least one canister of the n number of canisters, actuating the CVVs of less restricted canisters to open for an opening duration of each CVV based on the load of the relative canister, and actuating the first CVV to open for the third opening duration, wherein the opening durations of less restricted canisters is less than the third opening duration, and adjusting relative flow further includes commanding the VBV on to direct flow between the fuel tank and canisters with open CVVs. In a sixth example of the method, optionally including one or more or each of the first through fifth examples, commanding the VBV on to direct flow further comprises, when a CVV of a less restricted canister closes, maintaining the VBV on and wherein a pressure difference among the canisters adjusts a position of the VBV to allow communication between the fuel tank and canisters with open CVVs. In a seventh example of the method, optionally including one or more or each of the first through sixth examples, adjusting relative flow using the VBV and n number of CVVs for n number of canisters includes, when canister loads of the n number of canisters are equal, actuating the n number of CVVs to open for the third opening duration, and commanding the VBV on to direct flow in the third position, for the third opening duration.

The disclosure also provides support for a system, comprising a fuel tank fluidly coupled to at least two canisters via a single branched passage, wherein a balance valve is arranged upstream of a branch point of the branched passage relative to a direction of fuel vapor flow. In a first example of the system, the at least two canisters are positioned in parallel and are each on a branch of the branched passage downstream of the balance valve. In a second example of the system, optionally including the first example, the system further comprises a first canister vent valve (CVV) coupling the first canister to a first branch of a branched vent line and a second CVV coupling the second canister to a second branch of the branched vent line, the first and the second CVVs positioned downstream of the branch point of the branched vent line relative to direction of fuel vapor flow. In a third example of the system, optionally including one or both of the first and second examples, the system further comprises an optional bleed valve positioned on the branched vent line upstream of a branch point relative to the direction of fuel vapor flow, coupling an optional bleed canister to atmosphere. In a fourth example of the system, optionally including one or more or each of the first through third examples, passages of the branched passage and the branched vent line are sized to be similar in diameter and length. In a fifth example of the system, optionally including one or more or each of the first through fourth examples, the system further comprises a controller with computer readable instructions stored on non-transitory memory that, when executed during canister purging, cause the controller to adjust flow among the at least two canisters to increase flow through a higher loaded canister of the at least two canisters by adjusting open and closed positions of the at least two CVVs and on and off control of a n-way balance valve (VBV). In a sixth example of the system, optionally including one or more or each of the first through fifth examples, the controller further includes computer readable instructions stored on non-transitory memory that, when executed prior to canister purging, cause the controller to determine canister load of the at least two canisters by isolating one of the at least two canisters from the system and measuring pressure in the non-isolated canister of the at least two canisters. In a seventh example of the system, optionally including one or more or each of the first through sixth examples, the controller further includes computer readable instructions stored on non-transitory memory that, when executed prior to canister purging, cause the controller to learn duty cycles of the at least two CVVs by isolating one of the at least two canisters from the system and measuring a duration for pressure of a less loaded canister to equal pressure of the higher loaded canister of the at least two canisters.

The disclosure also provides support for a method for an evaporative emissions control system for a vehicle, comprising measuring restriction of each of at least two fuel vapor canisters, determining a first duty cycle of a first valve, a second duty cycle of a second valve, and so on for n number of valves, and duty cycling the first valve, the second valve, or any of the n number of valves based on the determined respective duty cycles, during canister purging and using a third, n-way balance valve to adjust flow among the at least two fuel vapor canisters to increase flow through a more restricted canister of the at least two fuel vapor canisters. In a first example of the method, measuring restriction of each of the at least two canisters includes coupling one of the at least two canisters to atmosphere by opening the respective valve, coupling the one of the at least two canisters to a fuel tank using the third valve, isolating the other of the n number of canisters from atmosphere and the fuel tank by closing the respective valves of the n number of valves, and measuring pressure in a purge line coupling the at least two canisters to an engine. In a second example of the method, optionally including the first example, determining the duty cycles includes comparing restriction of the at least two canisters, closing the valve of the more restricted canister of the at least two canisters, and duty cycling the valve of the less restricted canister of the at least two canisters until the pressure of the less restricted canister equals the pressure of the more restricted canister of the at least two canisters. In a third example of the method, optionally including one or both of the first and second examples, the valves of the n number of valves are duty cycled based on the determined duty cycles during vehicle refueling to equally load the at least two canisters with fuel vapors.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a vehicle, comprising:

purging at least two canisters, arranged in parallel along a loading flow direction and unloading flow direction, by adjusting flow among the at least two canisters to increase flow through a higher loaded canister of the at least two canisters during purging of the at least two canisters.

2. The method of claim 1, wherein the flow is adjusted via a n-way pressure balancing valve (VBV).

3. The method of claim 2, wherein adjusting flow using the VBV includes commanding the VBV to turn on, and where a first canister of at least two canisters is fluidically coupled to a fuel tank when the VBV is in a first position, a second canister of at least two canisters is fluidically coupled to the fuel tank when the VBV is in a second position, and so on for n number of canisters and n number of VBV positions, and all of the at least two canisters are fluidically coupled to the fuel tank when the VBV is in a third position.

4. The method of claim 2, wherein the flow is adjusted by adjusting relative opening durations of a first canister vent valve (CVV) of a first canister of at least two canisters and a second CVV of a second canister of at least two canisters, and so on for n number of canister vent valves of n number of canisters.

5. The method of claim 4, wherein a first opening duration of the first CVV is based on a load of the first canister, a second opening duration of the second CVV is based on a load of the second canister, and so on for n number of durations, n number of CVVs, and n number of canisters, and wherein a third opening duration of any of at least two CVVs is a duration of purging of the respective canister of at least two canisters.

6. The method of claim 5, wherein adjusting relative flow using the VBV and n number of CVVs for n number of canisters further includes, when a load of the first canister is greater than a load of at least one canister of the n number of canisters, actuating the CVVs of less restricted canisters to open for an opening duration of each CVV based on the load of the relative canister, and actuating the first CVV to open for the third opening duration, wherein the opening durations of less restricted canisters is less than the third opening duration, and adjusting relative flow further includes commanding the VBV on to direct flow between the fuel tank and canisters with open CVVs.

7. The method of claim 6, wherein commanding the VBV on to direct flow further comprises, when a CVV of a less restricted canister closes, maintaining the VBV on and wherein a pressure difference among the canisters adjusts a position of the VBV to allow communication between the fuel tank and canisters with open CVVs.

8. The method of claim 5, wherein adjusting relative flow using the VBV and n number of CVVs for n number of canisters includes, when canister loads of the n number of canisters are equal, actuating the n number of CVVs to open for the third opening duration, and commanding the VBV on to direct flow in the third position, for the third opening duration.

9. A system, comprising:

a fuel tank fluidly coupled to at least two canisters via a single branched passage, wherein a balance valve is arranged upstream of a branch point of the branched passage relative to a direction of fuel vapor flow.

10. The system of claim 9, wherein the at least two canisters are positioned in parallel and are each on a branch of the branched passage downstream of the balance valve.

11. The system of claim 9, further comprising a first canister vent valve (CVV) coupling the first canister to a first branch of a branched vent line and a second CVV coupling the second canister to a second branch of the branched vent line, the first and the second CVVs positioned downstream of the branch point of the branched vent line relative to direction of fuel vapor flow.

12. The system of claim 11, further comprising an optional bleed valve positioned on the branched vent line upstream of a branch point relative to the direction of fuel vapor flow, coupling an optional bleed canister to atmosphere.

13. The system of claim 11, wherein passages of the branched passage and the branched vent line are sized to be similar in diameter and length.

14. The system of claim 9, further comprising a controller with computer readable instructions stored on non-transitory memory that, when executed during canister purging, cause the controller to adjust flow among the at least two canisters to increase flow through a higher loaded canister of the at least two canisters by adjusting open and closed positions of the at least two CVVs and on and off control of a n-way balance valve (VBV).

15. The system of claim 14, wherein the controller further includes computer readable instructions stored on non-transitory memory that, when executed prior to canister purging, cause the controller to determine canister load of the at least two canisters by isolating one of the at least two canisters from the system and measuring pressure in the non-isolated canister of the at least two canisters.

16. The system of claim 14, wherein the controller further includes computer readable instructions stored on non-transitory memory that, when executed prior to canister purging, cause the controller to learn duty cycles of the at least two CVVs by isolating one of the at least two canisters from the system and measuring a duration for pressure of a less loaded canister to equal pressure of the higher loaded canister of the at least two canisters.

17. A method for an evaporative emissions control system for a vehicle, comprising:

measuring restriction of each of at least two fuel vapor canisters;

determining a first duty cycle of a first valve, a second duty cycle of a second valve, and so on for n number of valves; and duty cycling the first valve, the second valve, or any of the n number of valves based on the determined respective duty cycles, during canister purging and using a third, n-way balance valve to adjust flow among the at least two fuel vapor canisters to increase flow through a more restricted canister of the at least two fuel vapor canisters.

18. The method of claim 17, wherein measuring restriction of each of the at least two canisters includes coupling one of the at least two canisters to atmosphere by opening the respective valve, coupling the one of the at least two canisters to a fuel tank using the third valve, isolating the other of the n number of canisters from atmosphere and the fuel tank by closing the respective valves of the n number of valves, and measuring pressure in a purge line coupling the at least two canisters to an engine.

19. The method of claim 17, wherein determining the duty cycles includes comparing restriction of the at least two canisters, closing the valve of the more restricted canister of the at least two canisters, and duty cycling the valve of the less restricted canister of the at least two canisters until the pressure of the less restricted canister equals the pressure of the more restricted canister of the at least two canisters.

20. The method of claim 17, wherein the valves of the n number of valves are duty cycled based on the determined duty cycles during vehicle refueling to equally load the at least two canisters with fuel vapors.

* * * * *